US010602284B2

(12) United States Patent
Nilsson

(10) Patent No.: US 10,602,284 B2
(45) Date of Patent: Mar. 24, 2020

(54) TRANSDUCER MANAGEMENT

(71) Applicant: Cochlear Limited, Macquarie University, NSW (AU)

(72) Inventor: Soren Nilsson, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 475 days.

(21) Appl. No.: 15/212,917

(22) Filed: Jul. 18, 2016

(65) Prior Publication Data

US 2018/0020299 A1 Jan. 18, 2018

(51) Int. Cl.
*H04R 25/00* (2006.01)

(52) U.S. Cl.
CPC ..... *H04R 25/606* (2013.01); *H04R 25/305* (2013.01); *H04R 25/556* (2013.01); *H04R 2225/021* (2013.01); *H04R 2225/61* (2013.01); *H04R 2225/67* (2013.01)

(58) Field of Classification Search
CPC .. H04R 25/606; H04R 25/305; H04R 25/556; H04R 2225/021; H04R 2225/61; H04R 2225/67
USPC ..... 381/315
See application file for complete search history.

(56) References Cited

U.S. PATENT DOCUMENTS

| | | | |
|---|---|---|---|
| 4,532,930 | A | 8/1985 | Crosby et al. |
| 4,611,304 | A | 9/1986 | Butenko et al. |
| 4,776,322 | A | 10/1988 | Hough et al. |
| 4,992,966 | A | 2/1991 | Widin et al. |
| 5,144,674 | A | 9/1992 | Meyer et al. |
| 5,210,803 | A | 5/1993 | Martin et al. |
| 5,569,307 | A | 10/1996 | Schulman et al. |
| 5,571,148 | A | 11/1996 | Loeb et al. |
| 5,690,690 | A | 11/1997 | Nappholz et al. |
| 5,800,473 | A | 9/1998 | Faisandier |
| 5,817,137 | A | 10/1998 | Kaemmerer |
| 5,891,180 | A | 4/1999 | Greeninger et al. |
| 5,941,905 | A | 8/1999 | Single |
| 6,195,585 | B1 | 2/2001 | Karunasiri et al. |
| 6,198,971 | B1 | 3/2001 | Leysieffer |
| 6,219,580 | B1 | 4/2001 | Faltys et al. |
| 6,243,608 | B1 | 6/2001 | Pauly et al. |
| 6,285,909 | B1 | 9/2001 | Sweeney et al. |
| 6,308,099 | B1 | 10/2001 | Fox et al. |
| 6,327,501 | B1 | 12/2001 | Levine et al. |
| 6,443,891 | B1 | 9/2002 | Grevious |
| 6,482,154 | B1 | 11/2002 | Haubrich et al. |

(Continued)

FOREIGN PATENT DOCUMENTS

| | | | |
|---|---|---|---|
| DE | 19915846 | C1 | 8/2000 |
| EP | 0730882 | A2 | 9/1996 |

(Continued)

*Primary Examiner* — Sean H Nguyen
(74) *Attorney, Agent, or Firm* — Pilloff Passino & Cosenza LLP; Martin J. Cosenza

(57) ABSTRACT

A hearing prosthesis, including an actuator assembly, and a chassis supporting the actuator assembly, wherein the actuator assembly is configured to vibrate when an electrical current is applied to the actuator assembly such that a first apparatus of the actuator assembly vibrates relative to a second apparatus of the actuator assembly, the chassis is connected to the second apparatus, and the actuator assembly retains data related to an operational performance of the actuator assembly.

21 Claims, 39 Drawing Sheets

(56) References Cited

U.S. PATENT DOCUMENTS

| | | | | |
|---|---|---|---|---|
| 6,537,200 | B2 | 3/2003 | Leysieffer et al. | |
| 6,553,263 | B1 | 4/2003 | Meadows et al. | |
| 6,565,503 | B2 | 5/2003 | Leysieffer et al. | |
| 6,575,894 | B2 | 6/2003 | Leysieffer et al. | |
| 6,697,674 | B2 | 2/2004 | Leysieffer | |
| 6,738,670 | B1 | 5/2004 | Almendinger et al. | |
| 6,740,075 | B2 | 5/2004 | Lebel et al. | |
| 7,027,606 | B2 | 4/2006 | D'Agri | |
| 7,346,397 | B2 | 3/2008 | Money et al. | |
| 7,398,166 | B2 | 7/2008 | Stirnemann | |
| 7,502,653 | B2 | 3/2009 | Daly | |
| 8,107,635 | B2 | 1/2012 | Ludvigsen | |
| 8,315,708 | B2 | 11/2012 | Berthelsdorf et al. | |
| 8,884,870 | B2 * | 11/2014 | Grant | G06F 3/0483 345/156 |
| 2004/0024429 | A1 | 2/2004 | Daly | |
| 2004/0176822 | A1 | 9/2004 | Thompson et al. | |
| 2006/0020304 | A1 | 1/2006 | Torgerson et al. | |
| 2009/0306742 | A1 | 12/2009 | Van Dijk et al. | |
| 2010/0016922 | A1 * | 1/2010 | Daly | A61N 1/08 607/57 |
| 2010/0290647 | A1 * | 11/2010 | Abolfathi | G11B 33/06 381/151 |
| 2010/0329490 | A1 | 12/2010 | Van Schijndel et al. | |
| 2012/0059435 | A1 | 3/2012 | Daly | |
| 2013/0010984 | A1 * | 1/2013 | Hejnicki | H04R 27/00 381/107 |
| 2013/0209277 | A1 * | 8/2013 | Locke | F04B 53/00 417/53 |
| 2014/0275736 | A1 | 9/2014 | Ruppersberg et al. | |
| 2015/0125000 | A1 * | 5/2015 | Makivirta | H03G 5/165 381/103 |
| 2015/0125012 | A1 | 5/2015 | Sabin | |
| 2015/0163602 | A1 | 6/2015 | Pedersen et al. | |
| 2016/0057530 | A1 * | 2/2016 | Anderson | H04R 1/1041 381/384 |

FOREIGN PATENT DOCUMENTS

| | | | |
|---|---|---|---|
| WO | 0072917 | A1 | 12/2000 |
| WO | 0103622 | A1 | 1/2001 |
| WO | 0106810 | A2 | 1/2001 |
| WO | 0113991 | A1 | 3/2001 |
| WO | 03003956 | A1 | 1/2003 |
| WO | 03009207 | A1 | 1/2003 |

* cited by examiner

TRANSDUCER MANAGEMENT

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss, and may be suitable for individuals who cannot derive sufficient benefit from acoustic hearing aids, cochlear implants, etc., or for individuals who suffer from stuttering problems.

SUMMARY

In accordance with one aspect, there is a device, including a transducer including a machine readable memory device directly attached to the transducer.

In accordance with another aspect, there is a hearing prosthesis, comprising an actuator assembly, and a chassis supporting the actuator assembly, wherein the actuator assembly is configured to vibrate when an electrical current is applied to the actuator assembly such that a first apparatus of the actuator assembly vibrates relative to a second apparatus of the actuator assembly, the chassis is connected to the second apparatus, and the actuator assembly retains data related to an operational performance of the actuator assembly.

In accordance with another aspect, there is a method comprising obtaining an actuator having a memory storage device in which data is stored, and operating the actuator in part based on the data.

BRIEF DESCRIPTION OF THE DRAWINGS

Some embodiments are described below with reference to the attached drawings, in which.

DETAILED DESCRIPTION

Figure 1A:
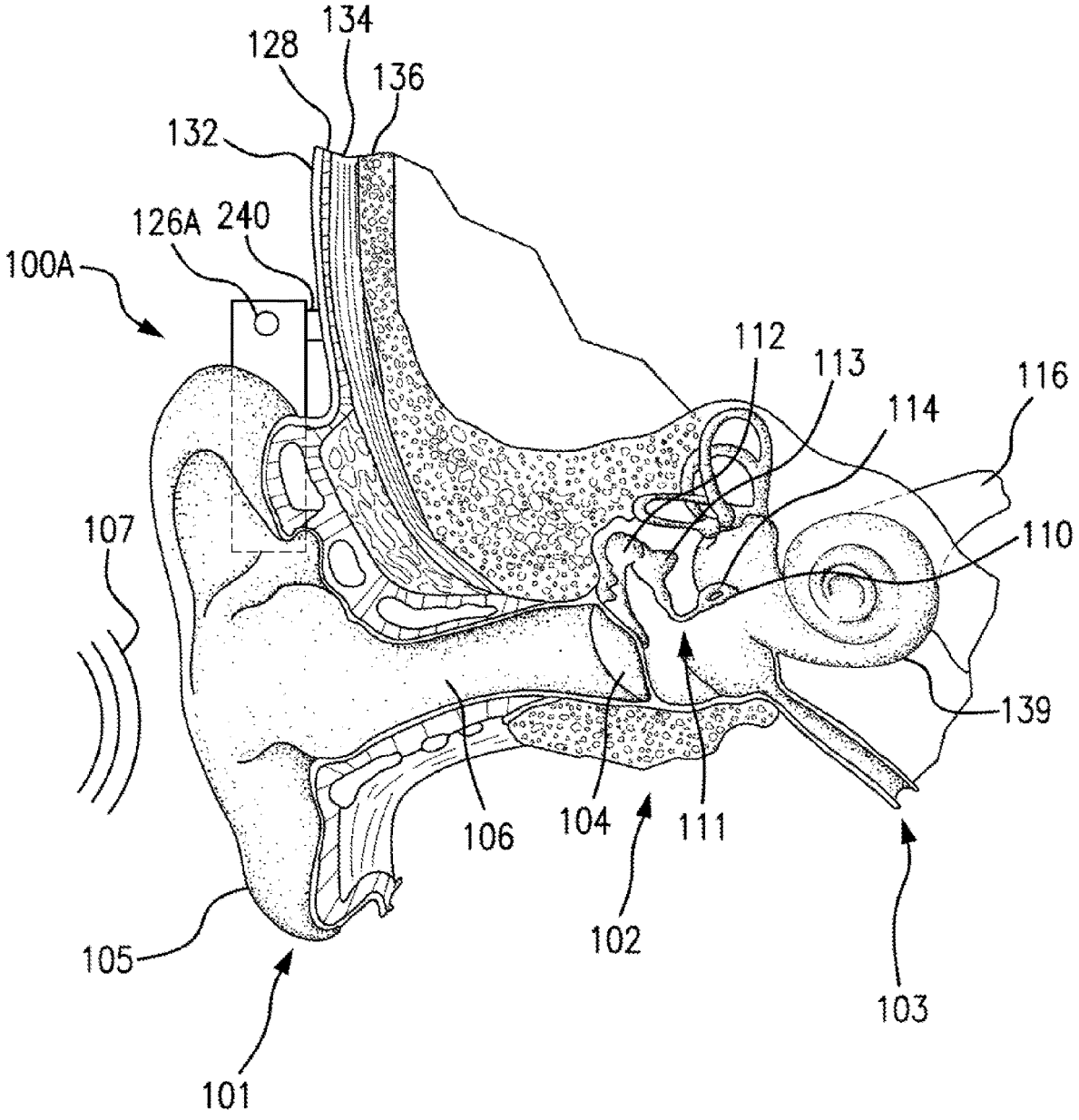
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101, a middle ear 102, and an inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113, and the stapes 114. The ossicles 111 of middle ear 102 serve to filter and amplify acoustic wave 107, causing oval window to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1A also illustrates the positioning of bone conduction device 100A relative to outer ear 101, middle ear 102, and inner ear 103 of a recipient of device 100. As shown, bone conduction device 100 is positioned behind outer ear 101 of the recipient, and comprises a sound input element 126A to receive sound signals. Sound input element 126A may comprise, for example, a microphone, telecoil, etc. In an exemplary embodiment, sound input element 126A may be located, for example, on or in bone conduction device 100A, or on a cable extending from bone conduction device 100A.

In an exemplary embodiment, bone conduction device 100A comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator, and/or a vibrating piezoelectric actuator and/or other type of actuator (not shown—which are sometimes referred to herein as a species of the genus vibrator) and/or various other operational components, such as sound input device 126A. In this regard, the operationally removable component is sometimes referred to herein as a vibrator unit. More particularly, sound input device 126A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 240 configured to operationally removably attach the operationally removable component to a bone conduction implant (also referred to as an anchor system and/or a fixation system) which is implanted in the recipient. In the embodiment of FIG. 1, coupling assembly 240 is coupled to the bone conduction implant (not shown) implanted in the recipient in a manner that is further detailed below with respect to exemplary embodiments of the bone conduction implant. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128, and skin 132 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g., the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
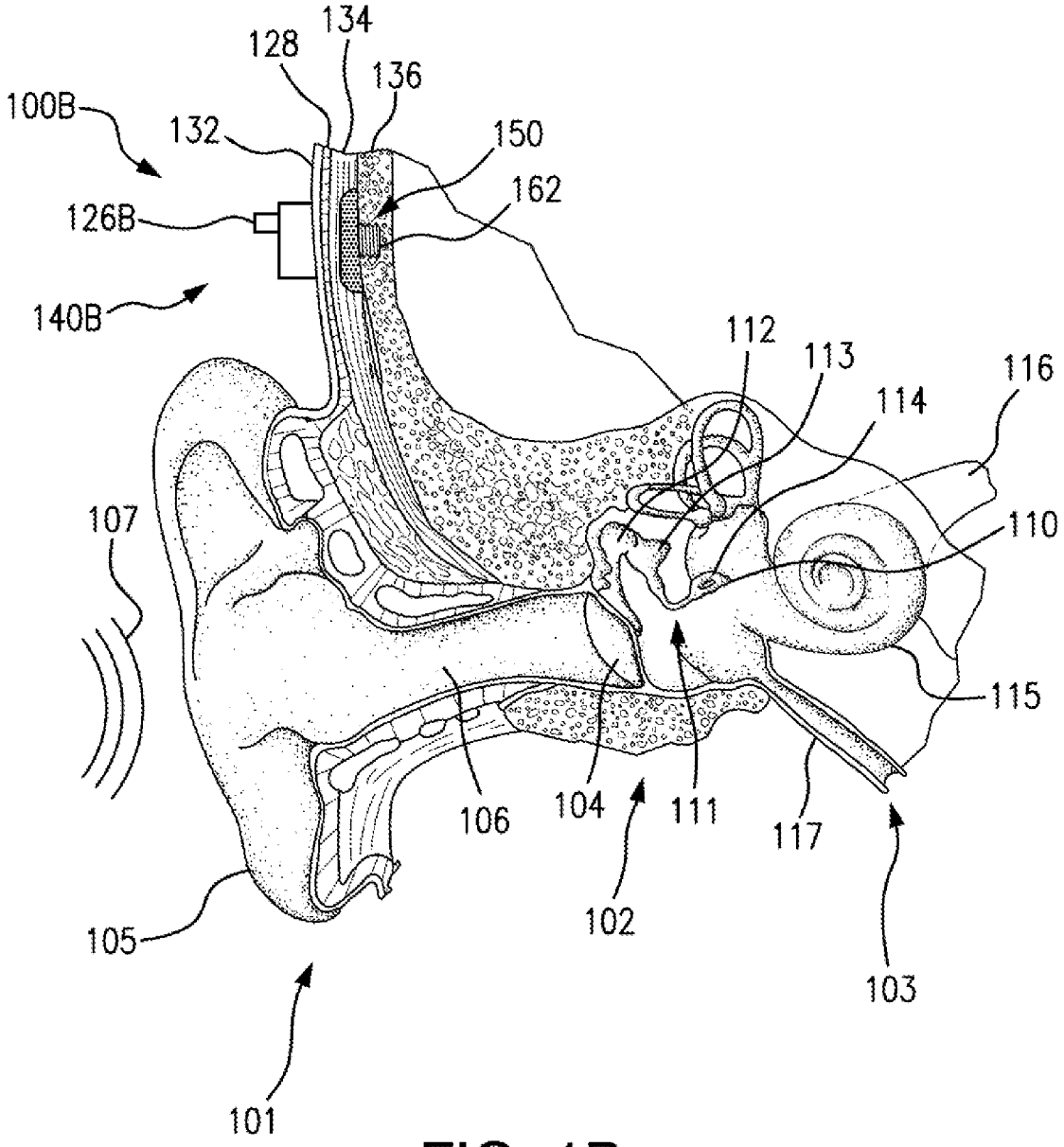
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1B also illustrates the positioning of bone conduction device 100B relative to outer ear 101, middle ear 102, and inner ear 103 of a recipient of device 100. As shown, bone conduction device 100 is positioned behind outer ear 101 of the recipient. Bone conduction device 100B comprises an external component 140B and implantable component 150. The bone conduction device 100B includes a sound input element 126B to receive sound signals. As with sound input element 126A, sound input element 126B may comprise, for example, a microphone, telecoil, etc. In an exemplary embodiment, sound input element 126B may be located, for example, on or in bone conduction device 100B, on a cable or tube extending from bone conduction device 100B, etc. Alternatively, sound input element 126B may be subcutaneously implanted in the recipient, or positioned in the recipient's ear. Sound input element 126B may also be a component that receives an electronic signal indicative of sound, such as, for example, from an external audio device. For example, sound input element 126B may receive a sound signal in the form of an electrical signal from an MP3 player electronically connected to sound input element 126B.

Bone conduction device 100B comprises a sound processor (not shown), an actuator (also not shown), and/or various other operational components. In operation, sound input device 126B converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B is a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B is an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2:
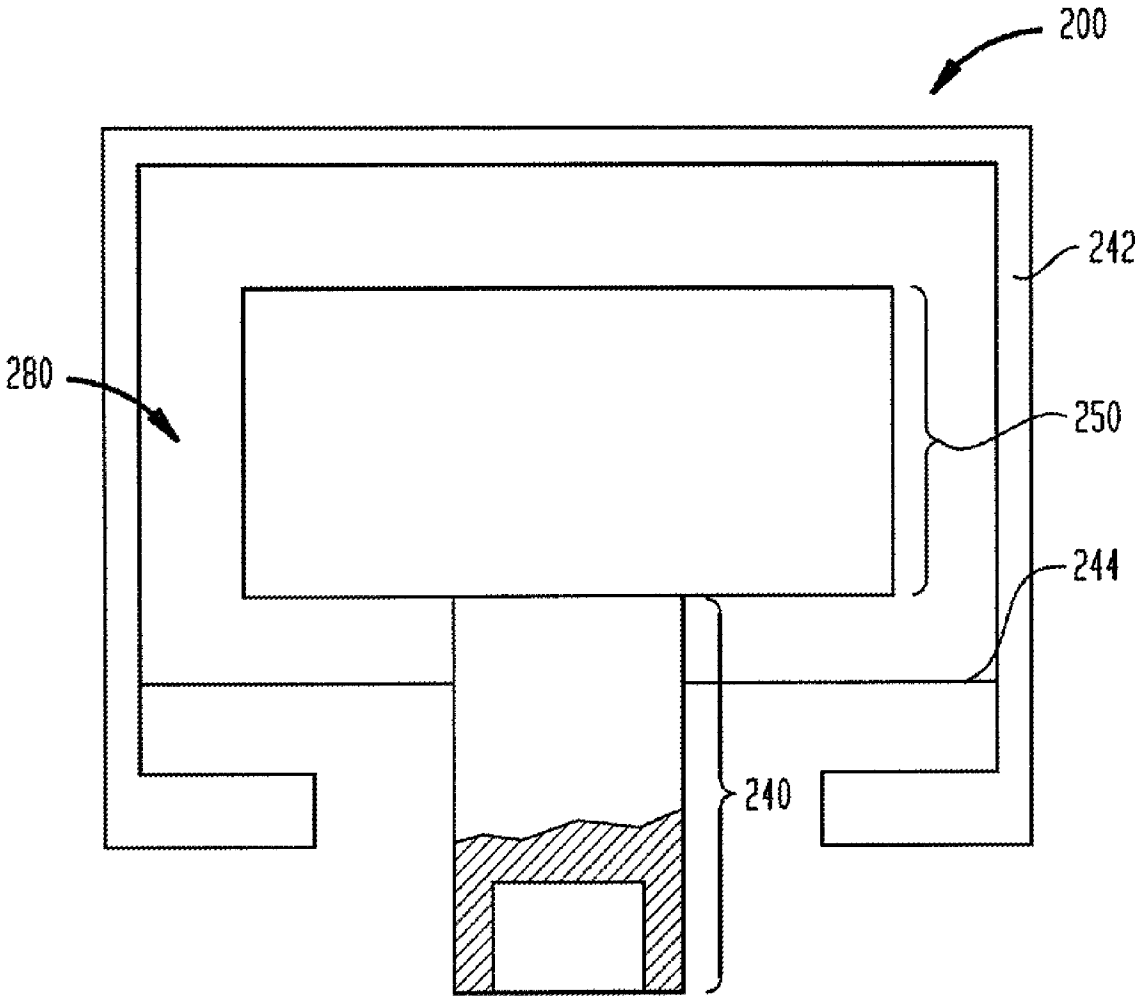
FIG. 2 is a schematic diagram conceptually illustrating a removable component of a percutaneous bone conduction device in accordance with at least some exemplary embodiments.

FIG. 2 is an embodiment of a removable component of a bone conduction device 200 in accordance with an embodiment corresponding to that of FIG. 1A, illustrating use of a percutaneous bone conduction device. Removable component 200, corresponding to, for example, element 100A of FIG. 1A, includes a housing 242, a vibrating electromagnetic actuator 250, a coupling assembly 240 that extends from housing 242 and is mechanically linked to vibrating electromagnetic actuator 250. Collectively, vibrating electromagnetic actuator 250 and coupling assembly 240 form a vibrating actuator-coupling assembly 280. Vibrating actuator-coupling assembly 280 is suspended in housing 242 by spring 244. In an exemplary embodiment, spring 244 is connected to coupling assembly 240, and vibrating electromagnetic actuator 250 is supported by coupling assembly 240.

Figure 3:
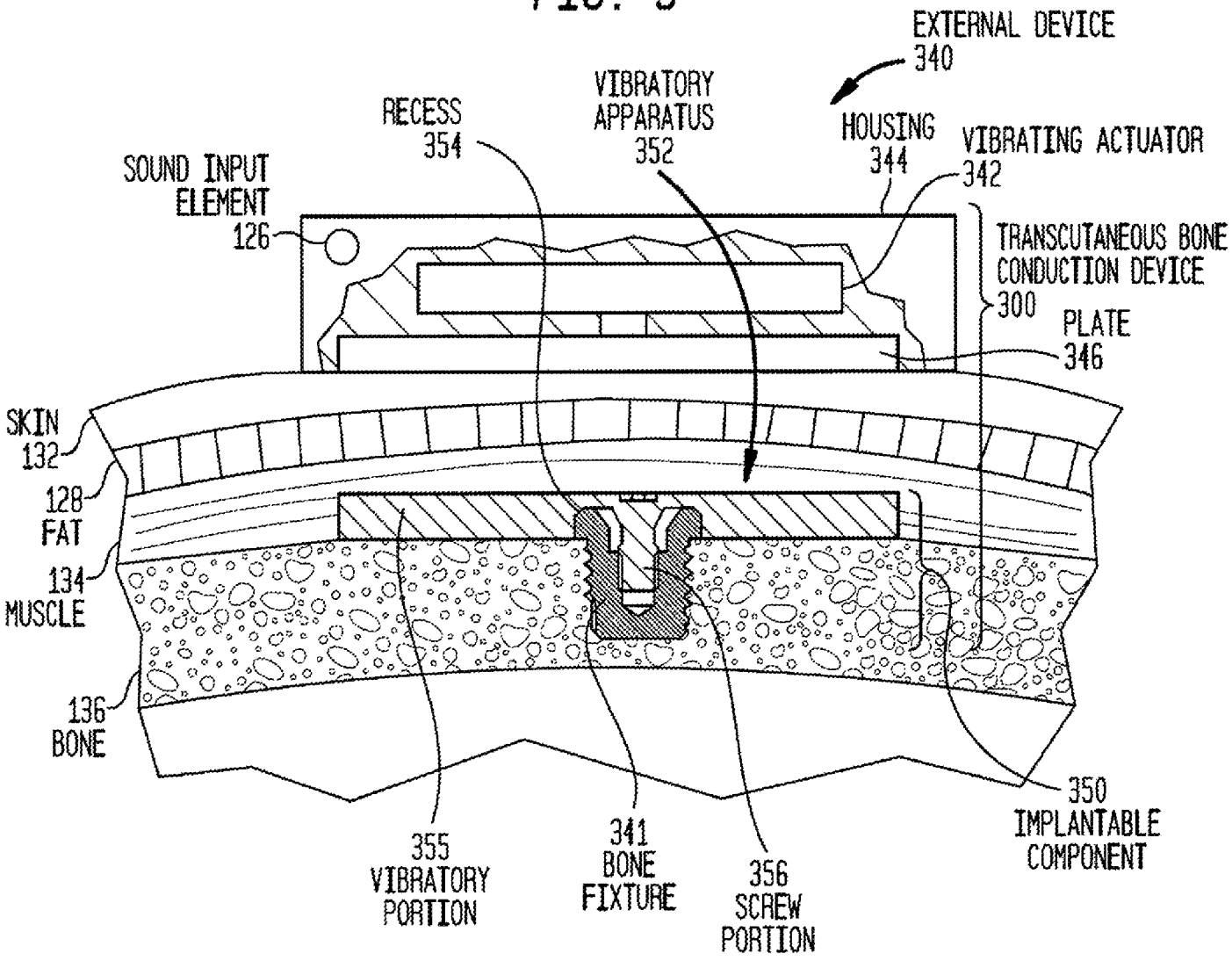
FIG. 3 is a schematic diagram conceptually illustrating a passive transcutaneous bone conduction device in accordance with at least some exemplary embodiments.

FIG. 3 depicts an exemplary embodiment of a transcutaneous bone conduction device 300 according to an embodiment that includes an external device 340 (corresponding to, for example, element 140B of FIG. 1B) and an implantable component 350 (corresponding to, for example, element 150 of FIG. 1B). The transcutaneous bone conduction device 300 of FIG. 3 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 4:
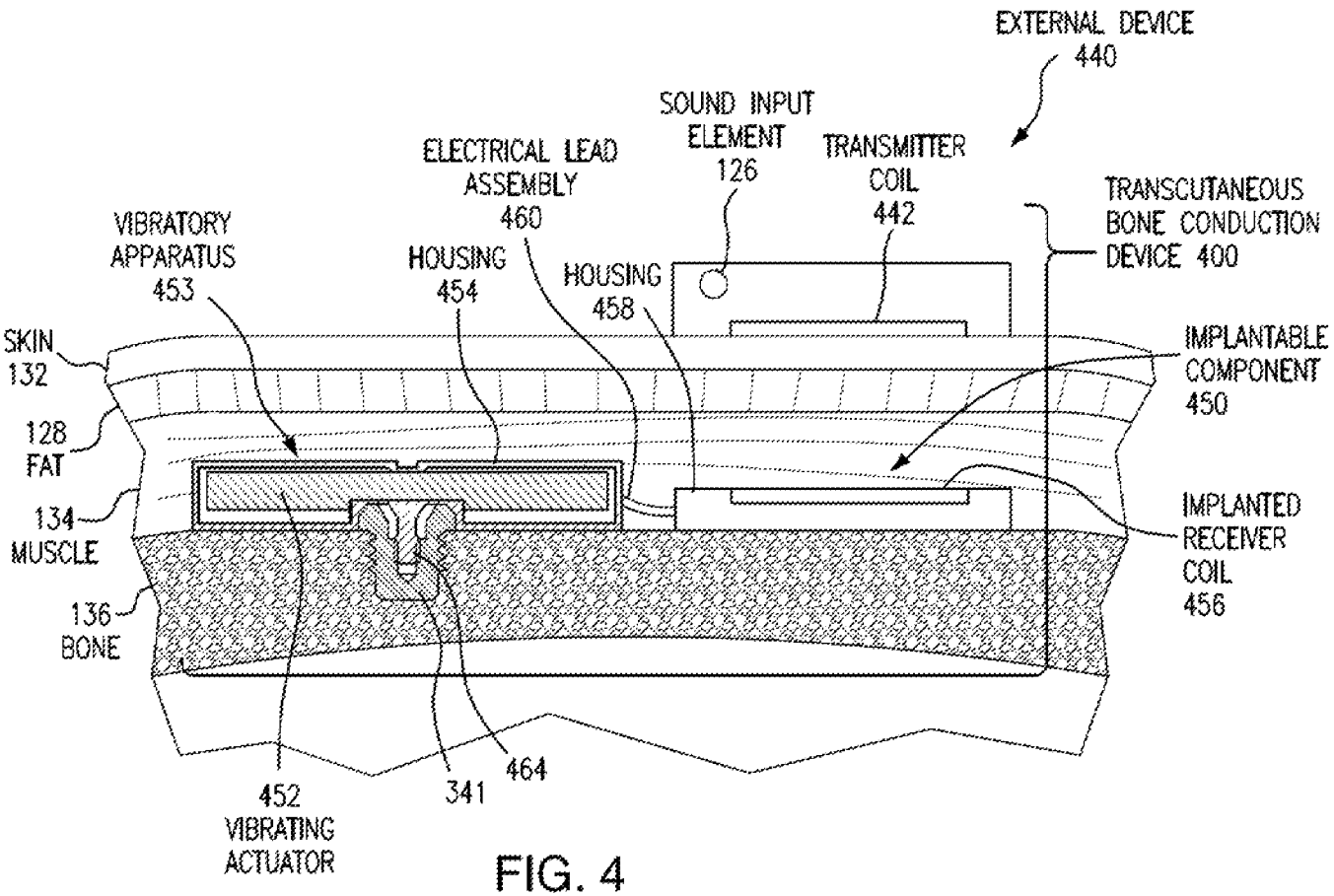
FIG. 4 is a schematic diagram conceptually illustrating an active transcutaneous bone conduction device in accordance with at least some exemplary embodiments.

FIG. 4 depicts an exemplary embodiment of a transcutaneous bone conduction device 400 according to another embodiment that includes an external device 440 (corresponding to, for example, element 140B of FIG. 1B) and an implantable component 450 (corresponding to, for example, element 150 of FIG. 1B). The transcutaneous bone conduction device 400 of FIG. 4 is an active transcutaneous bone conduction device in that the vibrating actuator 452 is located in the implantable component 450. Specifically, a vibratory element in the form of vibrating actuator 452 is located in housing 454 of the implantable component 450. In an exemplary embodiment, much like the vibrating actuator 342 described above with respect to transcutaneous bone conduction device 300, the vibrating actuator 452 is a device that converts electrical signals into vibration.

External component 440 includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating actuator 452 via electrical lead assembly 460. The vibrating electromagnetic actuator 452 converts the electrical signals into vibrations.

The vibrating electromagnetic actuator 452 is mechanically coupled to the housing 454. Housing 454 and vibrating actuator 452 collectively form a vibrating element 453. The housing 454 is substantially rigidly attached to bone fixture 341.

Some exemplary features of the vibrating electromagnetic actuator usable in some embodiments of the bone conduction devices detailed herein and/or variations thereof will now be described in terms of a vibrating electromagnetic actuator used in the context of the percutaneous bone conduction device of FIG. 1A. It is noted that any and/or all of these features and/or variations thereof may be utilized in transcutaneous bone conduction devices such as those of FIGS. 1B, 3, and 4 and/or other types of prostheses and/or medical devices and/or other devices, at least with respect to enabling utilitarian performance thereof. It is also noted that while the embodiments detailed herein are detailed with respect to an electromagnetic actuator, the teachings associated therewith are equally applicable to electromagnetic transducers that receive vibrations and output a signal indicative of the vibrations, at least unless otherwise noted. In this regard, it is noted that use of the term actuator herein also corresponds to transducer, and vice versa, unless otherwise noted. It is also noted that the teachings detailed herein are also applicable to other types of actuators and/or transducers, such as piezoelectric actuators, as will be described in greater detail below.

Figure 5A:
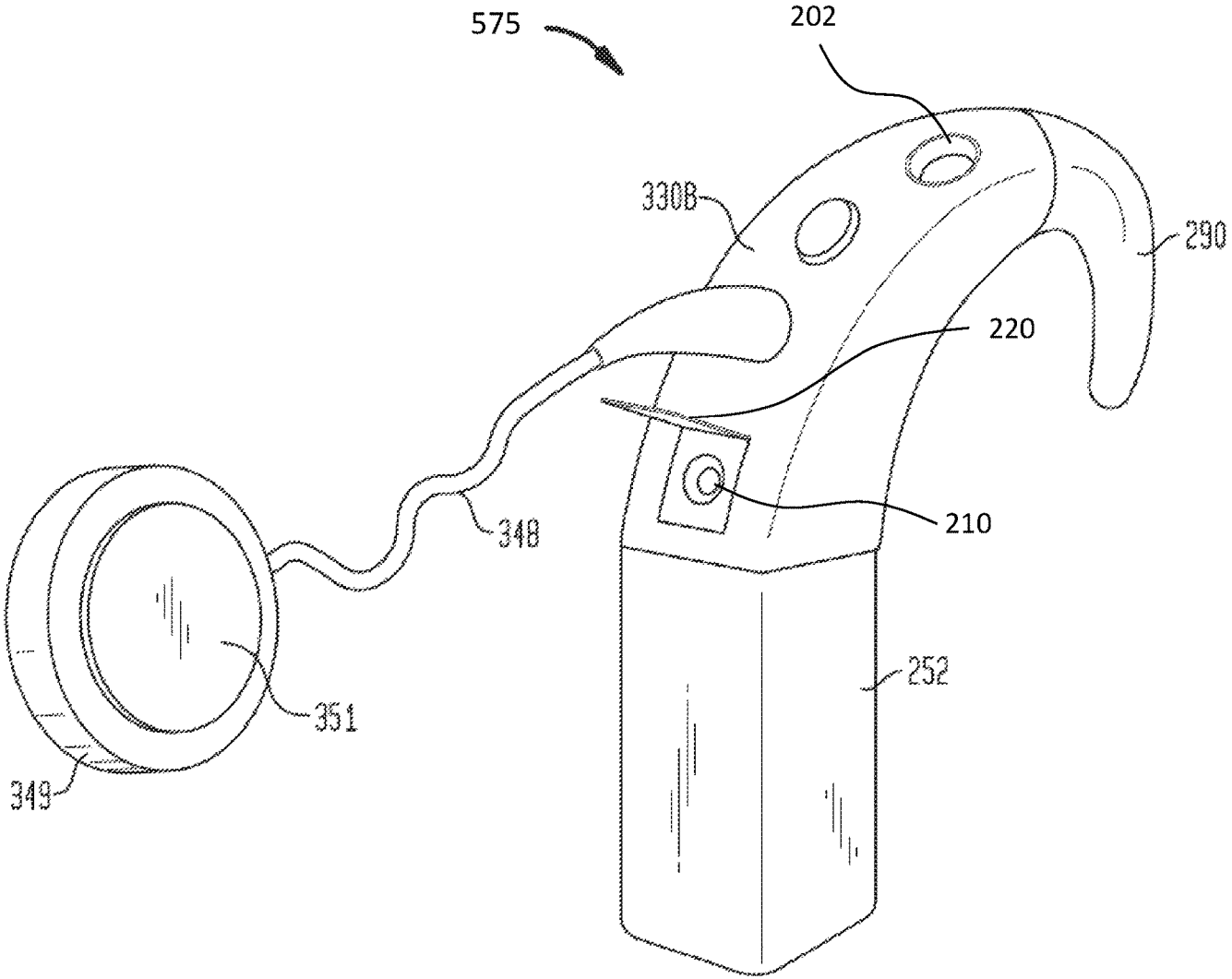
FIG. 5A is a schematic diagram conceptually illustrating a Behind-The-Ear (BTE) device that is a passive transcutaneous bone conduction device.

FIG. 5A depicts an alternate embodiment of an external component of a bone conduction device, BTE device 575, in which the vibrating actuator is located in a remote vibrator actuator unit 349 (sometimes referred to as a "button" in the art). Vibrator actuator unit 349 is in electronic communication with spine 330B via cable 348. In this regard, electrical signals are transferred to the vibrator actuator in vibrator actuator unit 349, these signals being, in some embodiments, the same as those which are provided to the other vibrator actuators detailed herein. Vibrator actuator unit 349 may include a coupling 351 to removably attach the unit 349 to outer skin of the recipient. Such a coupling may include, for example, adhesive. Alternatively, and/or in addition to this, coupling 351 can correspond to a magnet that couples via magnetic attraction to an implanted magnet within the recipient (e.g., an implanted magnet attached to the mastoid bone of the recipient underneath the skin of the recipient).

While the embodiment depicted in FIG. 5A utilizes a cable 348 to communicate with the remote vibrator actuator unit 349, in an alternative embodiment, a wireless link is utilized to communicate between the spine 330B and the remote vibrator actuator unit 349.

In at least some exemplary embodiments, the remote vibrator actuator unit 349 can contain a sound processor/sound processing unit or the like as opposed to, and/or in addition to, the spine 330B. Accordingly, in an exemplary embodiment, the remote vibrator actuator unit 349 can be a button sound processor. Conversely, in other embodiments, the spine 330B contains the sound processor.

It is noted that in some other embodiments, the vibrating actuator is located in the spine 330B, and in some such instances, the remote vibrator actuator unit is not present, as the vibrating actuator is located in the spine.

BTE device 575 includes one or more microphones 202, and may further include an audio signal jack 210 under a cover 220 on the spine 330B of BTE device 575. It is noted that in some other embodiments, one or both of these components (microphone 202 and/or jack 210) may be located on other positions of the BTE device 575, such as, for example, the side of the spine 330B (as opposed to the back of the spine 230, as depicted in FIG. 2), the ear hook 290, etc. FIG. 5A further depicts battery 252 and ear hook 290 removably attached to spine 330B.

In an exemplary embodiment, the vibrating actuator is a device that converts electrical signals into vibration. In operation, sound input element 202 converts sound into electrical signals. Specifically, these signals are provided to a sound processor (not shown) located in the spine 330B that processes the electrical signals, and then provides those processed signals to the vibrating actuator thereof. The vibrating actuator converts the electrical signals (processed or unprocessed) into vibrations, which are transferred into the skin and then to bone to evoke a hearing percept.

It is noted that while the embodiment of FIG. 5A depicts the microphone being located on the spine 330B at about the apex thereof, in an alternate embodiment, the microphone can be located elsewhere. It is further noted that the microphone can be located on the ear hook 290 anywhere from and including the tip thereof to the location where the ear hook interfaces with the spine. Such is also the case with respect to the microphone located on the spine 330B—the microphone can be located anywhere on the spine from the interface of the spine in the ear hook 290 to the interface of the battery 252 with the spine 330B. Still further, BTE device 575 can include a plurality of microphones located according to the various teachings detailed herein and/or variations thereof. Any microphone placement that can enable the teachings detailed herein and/or variations thereof to be practiced can be utilized in at least some exemplary embodiments.

In some exemplary embodiments, any device, system, and/or method that will enable the teachings detailed herein and/or variations thereof associated with vibration transmission from the actuator to the skin and/or to bone of the recipient may be utilized.

It is noted that in some embodiments, the vibrating actuator is a replaceable component relative to that of the sound processor to which it is in signal communication and/or the microphone to which the vibrating actuator is in signal communication. Alternatively, and/or in addition to this, the sound processor and/or the microphone is a replaceable component relative to that of the vibrating actuator. That is, in some embodiments, a scenario can exist where a vibrating actuator can fail or otherwise become less than utilitarian vis-à-vis that which would result if a new vibrating actuator was utilized with the current sound processor. This as opposed to obtaining an entirely new external component of a hearing prosthesis (or obtaining an entirely new implantable component, in the case of a totally implantable hearing prosthesis where the sound processor and/or other components are implanted in the recipient), where there are certain features associated with the sound processor that are desirable to be retained or the like for future use. For example, the sound processing algorithms could have been adjusted during an initial fitting process with the recipient, and sometimes fine-tuned or otherwise adjusted during normal use subsequent to the fitting process to further refine the recipient's hearing experience. There can be utilitarian value with respect to maintaining such refinements for use with the new vibrating actuator, and thus maintaining the sound processor. (That said, in some alternate embodiments, the settings of the existing sound processor can be transferred to an entirely new prosthesis which would have an entirely new sound processor and an entirely new vibrating actuator. Some additional features of this alternate scenario will be described in greater detail below.)

Also, there can be utilitarian value with respect to replacing a failed sound processor or otherwise upgrading an existing sound processor, while maintaining the same vibrating actuator in the external component (or implantable component).

Some additional details of the replacements of the vibrating actuator and/or sound processor and/or other components relative to one another will be described in greater detail below. First however, an exemplary framework associated with the vibrating actuator's relative to the other components of a given hearing prosthesis will now be described.

Figure 5B:
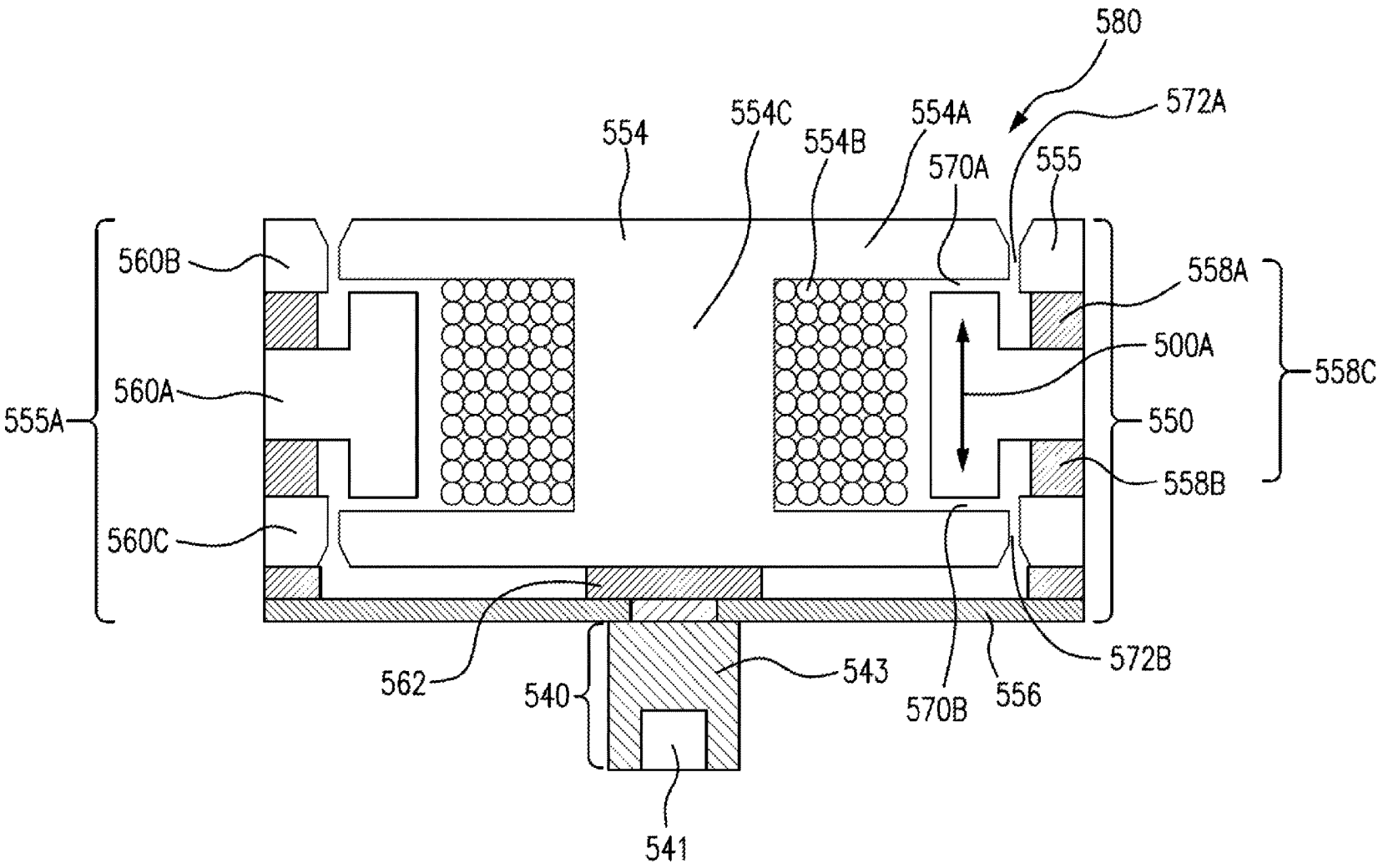
FIG. 5B is a schematic diagram conceptually illustrating a component of the bone conduction device of FIG. 2.

FIG. 5B is a cross-sectional view of a vibrating actuator-coupling assembly 580, which can correspond to vibrating actuator-coupling assembly 280 detailed above. The vibrating actuator-coupling assembly 580 includes a vibrating electromagnetic actuator 550 and a coupling assembly 540. The vibrating electromagnetic actuator 550 can be utilized essentially as is and/or with modifications for compatibility as the vibrating actuator of the various embodiments detailed above. Coupling assembly 540 includes a coupling 541 mounted on coupling shaft 543.

As illustrated in FIG. 5B, vibrating electromagnetic actuator 550 includes a bobbin assembly 554 and a counterweight assembly 555. As illustrated, bobbin assembly 554 includes a bobbin 554A and a coil 554B that is wrapped around a core 554C of bobbin 554A. In the illustrated embodiment, bobbin assembly 554 is radially symmetrical.

Counterweight assembly 555 includes spring 556, permanent magnets 558A and 558B, yokes 560A, 560B, and 560C, and spacer 562. Spacer 562 provides a connective support between spring 556 and the other elements of counterweight assembly 555 just detailed. Spring 556 connects bobbin assembly 554 via spacer 524 to the rest of counterweight assembly 555, and permits counterweight assembly 555 to move relative to bobbin assembly 554 upon interaction of a dynamic magnetic flux, produced by bobbin assembly 554.

Coil 554B, in particular, may be energized with an alternating current to create the dynamic magnetic flux about coil 554B. Conversely, permanent magnets 558A and 558B generate a static magnetic flux. These permanent magnets 558A and 558B are part of counterweight assembly 555, which also includes yokes 560A, 560B, and 560C. The yokes 560A, 560B, and 560C can be made of a soft iron in some embodiments.

As may be seen, vibrating electromagnetic actuator 550 includes two axial air gaps 570A and 570B that are located between bobbin assembly 554 and counterweight assembly 555. With respect to a radially symmetrical bobbin assembly 554 and counterweight assembly 555, such as that detailed in FIG. 5, air gaps 570A and 570B extend in the direction of relative movement between bobbin assembly 554 and counterweight assembly 555, indicated by arrow 500A.

Further, as may be seen in FIG. 5B, the vibrating electromagnetic actuator 550 includes two radial air gaps 572A and 572B that are located between bobbin assembly 554 and counterweight assembly 555. With respect to a radially symmetrical bobbin assembly 554 and counterweight assembly 555, the air gap extends about the direction of relative movement between bobbin assembly 554 and counterweight assembly 555. As may be seen in FIG. 5, the permanent magnets 558A and 558B are arranged such that their respective south poles face each other and their respective north poles face away from each other. It is noted that in an alternate embodiment, the reverse can be the case (respective north poles face towards each other and respective south poles face away from each other).

In the electromagnetic actuator of FIG. 5B, the radial air gaps 572A and 572B close static magnetic flux between the bobbin 554A and the yokes 560B and 560C, respectively. Further, axial air gaps 570A and 570B close the static and dynamic magnetic flux between the bobbin 554A and the yoke 560A. Accordingly, in the radially symmetrical device of FIG. 5, there are a total of four (4) air gaps.

It is noted that the electromagnetic actuator of FIG. 5B is a balanced actuator. An alternate configuration of a balanced actuator can be achieved by adding additional axial air gaps above and below the outside of bobbin 554B (and in some variations thereof, the radial air gaps are not present due to the addition of the additional axial air gaps). In such an alternate configuration, the yokes 560B and 560C are reconfigured to extend up and over the outside of bobbin 554B (the geometry of the permanent magnets 558A and 558B and/or the yoke 560A might also be reconfigured to achieve utility of the actuator). It is also noted that in some exemplary embodiments, an unbalanced electromagnetic actuator can be utilized as the vibrating actuator. Indeed, as will be described in greater detail below, piezoelectric actuators can be utilized as the vibrating actuator. Any actuator that can be utilized to evoke a hearing percept, whether such be done via bone conduction or another regime (e.g., such as that which results from the utilization of an actuator in a middle ear implant or the like, etc., or such as that which results from the speaker (sometimes called the receiver) of a traditional acoustic hearing aid), can be utilized in at least some exemplary embodiments. That is, the teachings detailed herein are directed to any actuator that is utilized to evoke a hearing percept. Thus, unless otherwise explicitly stated, the phrases/terms "actuator," "actuator assembly," "transducer" and "transducer assembly," encompass any type of apparatus that is a component that moves relative to another component in direct and/or indirect response to a sound (whether that sound be a captured ambient sound conducted through the atmosphere or a sound provided to a device via a cable or a wireless electromagnetic transmission (such as that which can result from an MP3 player or from a radio transmission, etc.) to evoke a hearing percept. In an exemplary embodiment, the aforementioned actuators and transducers are electric actuators and transducers, where the aforementioned relative movements are a result of the application of an electrical current to a component of the actuator/transducer.

Figure 6:
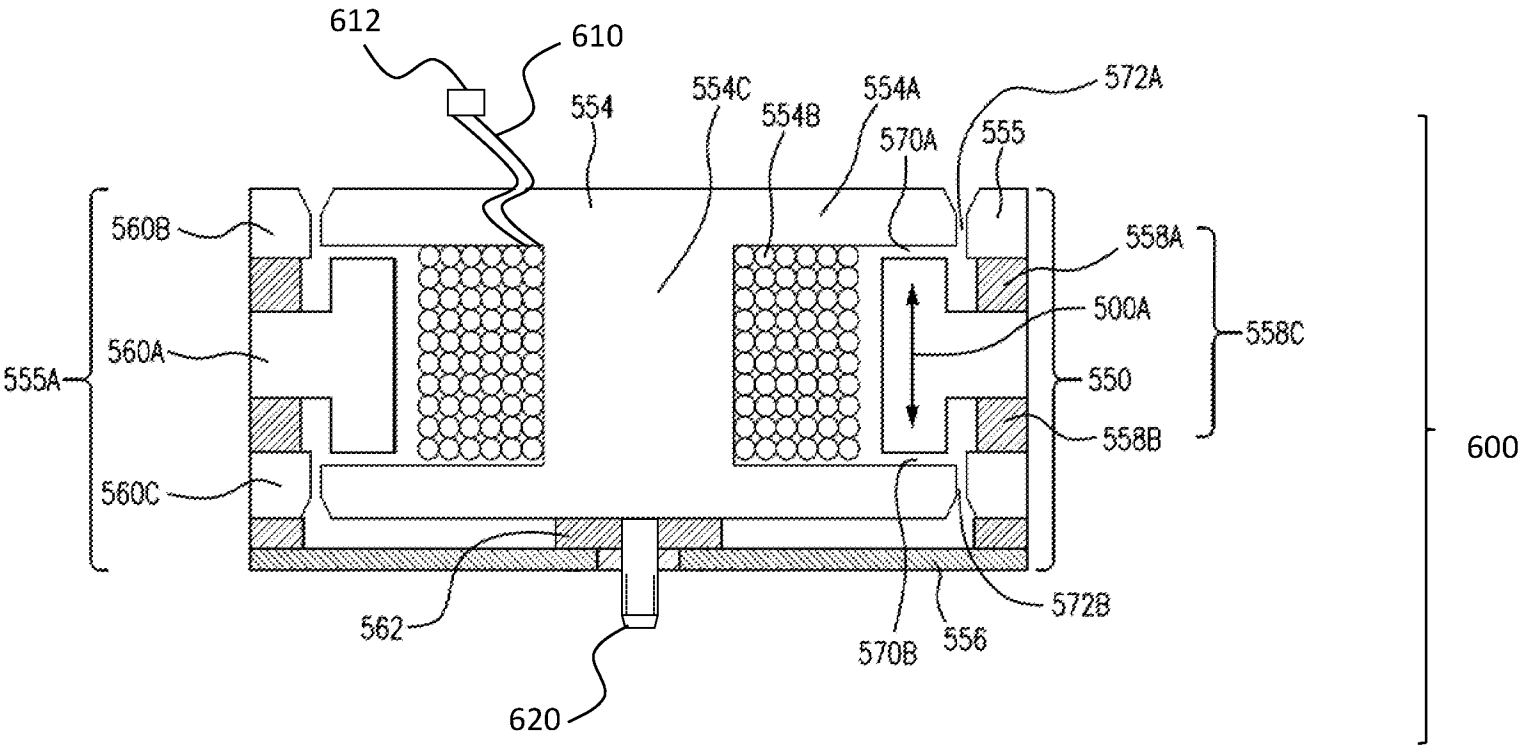
FIG. 6 is another schematic diagram conceptually illustrating a variation of a component of the bone conduction device of FIG. 2.

Returning back to the replacement ability of the vibrating actuator relative to the other components of the hearing prosthesis, FIG. 6 depicts an exemplary actuator assembly 600, which includes the structure vibrating actuator 550 plus attachment component 620 and electrical lead 610 having connector 612 located at the end thereof (it is noted that the embodiment depicted in FIG. 6 only shows one lead 610—in some embodiments, two or more leads are present so as to provide electrical communication to the beginning and the end of the coil 554B—an additional connector can be utilized or a single connector can be utilized that is bifurcated to ensure electrical insulation between the input and the output sub-connector components). In at least some exemplary embodiments, the connector 612 is attached to a separate connector (not shown in FIG. 6—additional details of such are described below) to disconnectably place the actuator assembly 600 into signal communication with a sound processor and/or a microphone. With respect to the attachment component, the attachment component can be a threaded stud/bolt extending from the bobbin body 554C and rigidly connected thereto (in some embodiments, the attachment component can be a part of the bobbin). In some exemplary embodiments, the chassis or the like (more on this below) into which the actuator assembly 600 is inserted or otherwise that supports the actuator assembly includes a female threaded receptacle to enable the actuator assembly 600 to be threaded therein, thus securing or otherwise attaching the actuator assembly 600 to the chassis. As will be understood from the FIG. 6, it can be seen that the actuator assembly 600 can be readily removed from the chassis by disconnecting any connection to connector 612 and unscrewing the actuator assembly 600 from the chassis.

It is noted that the term chassis as used herein can correspond to something that envelops the actuator assembly, but also something that supports the actuator assembly. In this regard, in an exemplary embodiment, the chassis can correspond to the coupling assembly 540. In this regard, the coupling assembly 540 can have a female screw thread in the coupling shaft 543, thus enabling the coupling assembly 540 to be removably attached to the actuator assembly 600, thereby establishing, in an exemplary embodiment, the vibrating actuator coupling assembly 580 depicted in FIG. 5. (Some additional details of this embodiment are described in greater detail below with respect to the locations of the microphones in the sound processor.)

To be clear, the embodiment of FIG. 6 can also be used in conjunction with the embodiments of FIGS. 3 and 4 and 5A. For example, the plate that interfaces with the skin with respect to the passive transcutaneous bone conduction device can have a threaded hole therein, so that the attachment component 620 can be threaded therein to attach the plates to the actuator assembly 600, thus placing the actuator assembly 600 into vibrational communication with the plate. Still further, the actuator assembly 600 can be placed in the housing 454 of the implantable component 450 of the embodiment of FIG. 4. In some exemplary embodiments, the feature associated with the threaded attachment component 620 can be utilized in conjunction with a female threaded component located in the male threaded component 464 so as to preserve a hermetic environment within the housing 454. That said, in an alternate embodiment, the attachment component 620 can be configured to be threaded directly into the bone fixture 341. Also, it is noted that an inverted system can be utilized in a scenario where there is insufficient room for the attachment component 620 on the side that faces the bone. For example, the housing 454 and/or housing 344 could have the female threaded receptacle in the roof thereof (e.g., the side facing away from the bone of the recipient), and the actuator assembly can hang like a sleeping bat therein (hereinafter, this is sometimes referred to as the sleeping bat embodiment).

Figure 7:
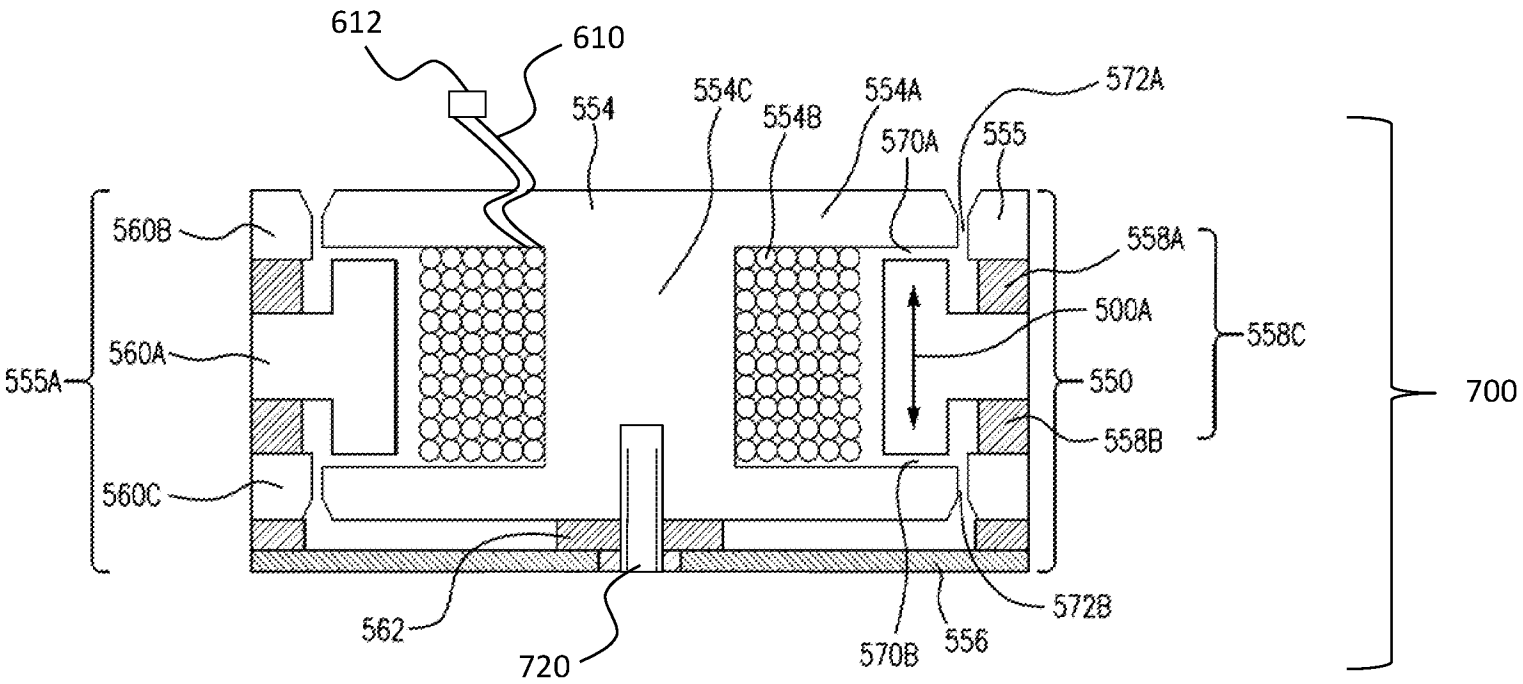
FIG. 7 is another schematic diagram conceptually illustrating another variation of a component of the bone conduction device of FIG. 2.

FIG. 7 depicts another exemplary embodiment of an actuator assembly 700, which is identical to that of the embodiment of FIG. 6, except that the attachment component 620 has been replaced with an attachment component 720. Here, the attachment component 720 is a female threaded receptacle that extends into the bobbin 554C. In an exemplary embodiment, the chassis that supports the actuator assembly 700 has a threaded male stud or the like and the actuator assembly 700 is threaded onto the male stud so as to connect the actuator assembly 700 and the chassis. In an exemplary embodiment, the shaft 543 can include this male threaded stud, and thus attachment of the shaft 543 to the actuator assembly 700 results in the embodiment of FIG. 5B. As used herein, the term chassis can correspond to any component or sub-component that supports the actuator. In an exemplary embodiment, the chassis includes or otherwise is connectable to a body interface component. With respect to the former, this can correspond to the plate 356 of the embodiment of FIG. 3. With respect to the latter, this can correspond to the ability to connect to an abutment of a percutaneous bone conduction device that is fixed to a bone fixture embedded in bone of the recipient such as that which is utilized in accordance with the embodiment of FIG. 2. In view of this, it is to be understood that at least some exemplary embodiments include a transducer that is configured to be removably mounted to a body interface component.

Figure 8:
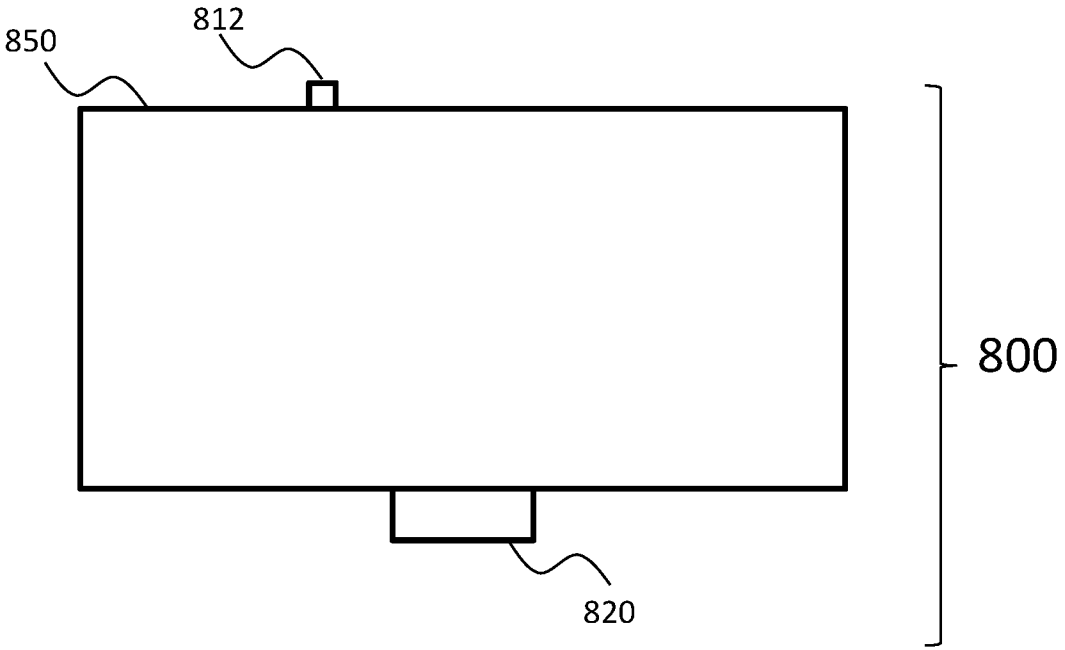
FIG. 8 is a conceptual diagram depicting an exemplary actuator assembly according to an exemplary embodiment.
Figure 9:
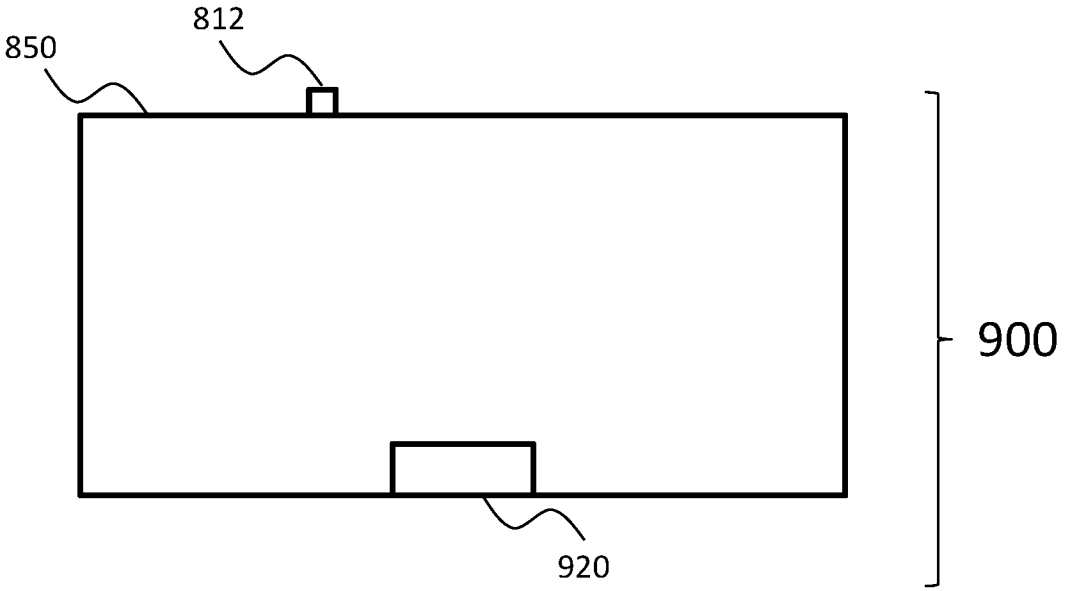
FIG. 9 is a conceptual diagram depicting another exemplary actuator assembly according to an exemplary embodiment.

Conceptually, the embodiments of FIGS. 6 and 7 are represented in the embodiments of FIGS. 8 and 9. FIG. 8 depicts an exemplary transducer assembly 800 that includes the vibrating actuator 850, which corresponds to any actuator detailed herein and/or variations thereof (and thus any transducer detailed herein and/or variations thereof), and attachment component 820 (functionally represented by a male portion, thus corresponding to the embodiment of FIG. 6), and signal connector 812 (which corresponds to the connector 612 detailed above) so that the actuator/transducer can be placed into signal communication with a sound processor and/or a microphone, etc., so that the actuator can be actuated by the application of a signal (e.g., electrical signal) thereto and/or so that the transducer can output a signal to these components. FIG. 9 depicts an exemplary transducer assembly 900 that includes the vibrating actuator 950, which corresponds to any actuator detailed herein and/or variations thereof (and thus any transducer detailed herein and/or variations thereof), and attachment component 920 (functionally represented by a female portion, thus corresponding to the embodiment of FIG. 7), and signal connector 812 (which corresponds to the connector 612 detailed above) so that the actuator/transducer can be placed into signal communication with a sound processor and/or a microphone, etc., so that the actuator can be actuated by the application of a signal (e.g., electrical signal) thereto and/or so that the transducer can output a signal to these components.

Figure 10:
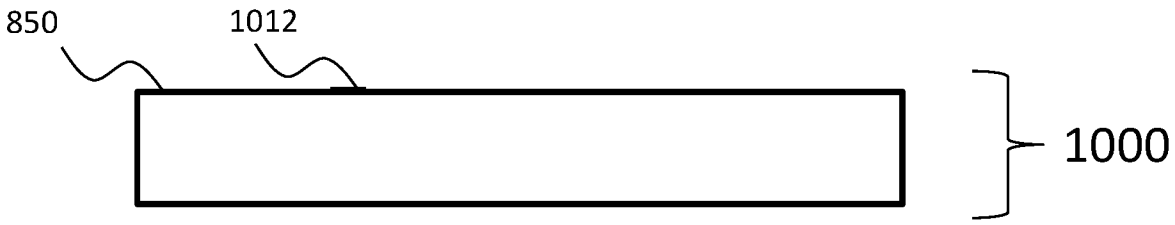
FIG. 10 is a conceptual diagram depicting another exemplary actuator assembly according to an exemplary embodiment.

It is also noted that some embodiments do not have a dedicated attachment component and/or a dedicated signal connection connector. To this end, FIG. 10 depicts an exemplary actuator assembly 1000, which entails vibrating actuator 1050 and bonding pad 1012. In an exemplary embodiment, the actuator assembly 1000 is connected to a given chassis via components that are separate from the removable/replaceable actuator assembly 1000. In this regard, in an exemplary embodiment, the chassis can include a snap coupling or the like that couples about a superstructure of the actuator assembly 1000. Still further, in an exemplary embodiment, the actuator assembly 1000 is placed in electrical communication/signal communication with a sound processor and/or a microphone or the like via bonding pads 1012, where electrical leads or soldered to the bonding pads 1012. Thus, there is no dedicated electrical connection per se on the actuator assembly 1000.

To summarize, an actuator assembly and/or a transducer assembly can correspond to an assembly that has one component that moves relative to another component when activated (in the case of an actuator) or when subjected to an exterior force (in the case of the transducer where the transducer assembly is used as a sensor, such as a vibration sensor). These components can be assemblies that move relative to one another.

In an exemplary embodiment, an actuator assembly/transducer assembly can be an assembly without dedicated coupling components and/or without dedicated electrical connectors. That said, in an exemplary embodiment, the teachings detailed herein include a transducer that is an actuator (and can be an actuator assembly) that is devoid of any other electronic components except for the electronic components that induce actuation forces in the transducer and input-output apparatuses thereof (e.g., connector 612) if present in the device of which the actuator is a part (i.e., if such connectors are not present in the device that is utilized by the actuator, the actuator assembly will thus necessarily be devoid of those connectors, if such connectors are utilized in the device, those connectors would not be excluded from the scope of the actuator/actuator assembly).

Some exemplary interactions of the actuator assembly with other components of the hearing prosthesis in general, and the chassis supporting the actuator assembly in particular, will now be described.

Figure 11:
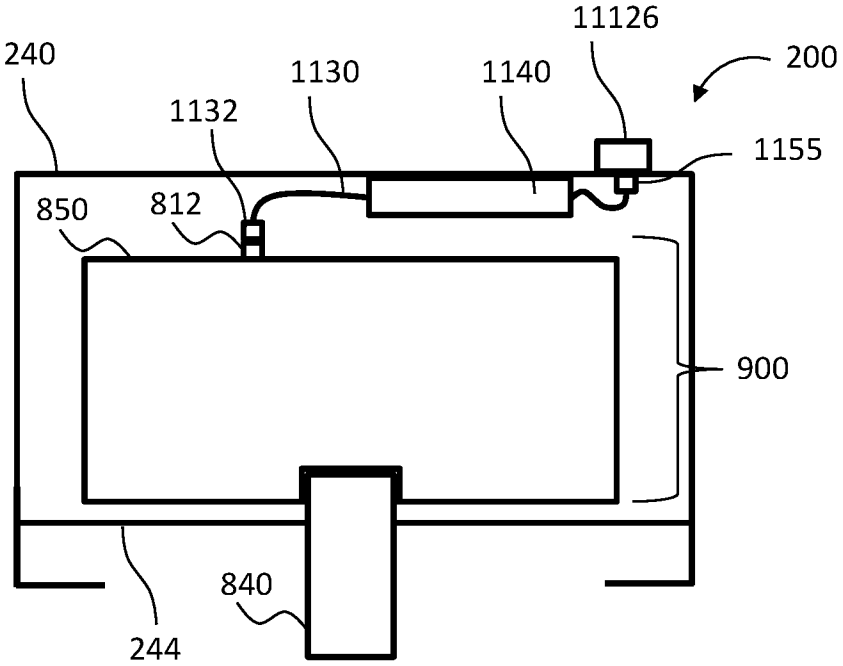
FIG. 11 is a conceptual diagram depicting additional details of the embodiment of FIG. 2.

FIG. 11 depicts a detailed version of the embodiment of FIG. 2, where actuator assembly 900 is located inside the housing 240 of the removable component 200 of the percutaneous bone conduction device. Some additional details of the removable component 200 of the percutaneous bone conduction device can be seen in FIG. 11. For example, the sound processor 1140, which is in signal communication with the microphone 11126 via connector 1155, depicted as being mounted on the top of the housing 240. In this exemplary embodiment, sound captured by the microphone 11126 is transduced into electrical signals, which are provided to the sound processor 1140. The sound processor 1140 processes the signal according to an algorithm that has been customized to the given recipient (e.g. via fitting process) and outputs electrical signals via electrical lead 1130, which is coupled via connector 1132 to connector 812 of the actuator assembly 900, thus placing the sound processor 1140 into signal communication with the coil of the bobbin of the actuator assembly 900 (in the embodiments that utilize electromagnetic actuator—in some alternate embodiments that utilize a piezoelectric actuator, the sound processor 1140 would be placed into signal communication with the piezoelectric material of the piezoelectric actuator). As can be seen, coupling assembly 840, which is representative of coupling assembly 240 of FIG. 2, is depicted as including a male portion that is inserted into the female portion of the attachment component of the actuator assembly 900. Consistent with the embodiment of FIG. 2, spring 244 is connected to the coupling assembly 840, which spring supports the housing 240 so as to at least partially vibrationally isolate the housing 240 from the vibrations generated by the actuator assembly 900. In this regard, the coupling assembly 840 corresponds to a chassis or at least a sub-chassis where, the housing 240 is also sub-chassis, the combined components forming a chassis assembly In an exemplary scenario of use of the removable component 200, for the reason, there is utilitarian value with respect to removing the actuator assembly 900 and replacing the actuator assembly 900 with a new actuator assembly. That said, as will be detailed below, in some alternate embodiments, the teachings detailed herein and/or variations thereof are applicable to a scenario where the actuator assembly 900 is simply a new actuator assembly connected to the sound processor 1140 for the first time, where no actuator assembly 900 has ever been present within the housing 240.

It is noted that while the sound processor 1140 is depicted as being mounted on the housing 240, in an alternate embodiment, the sound processor 1140 can be mounted on the bobbin of the actuator assembly, while in other embodiments, the sound processor 1140 can be mounted on the seismic mass of the actuator assembly. In an exemplary embodiment, this is done in a removable manner so as to enable the actuator assembly to be replaced.

Figure 12:
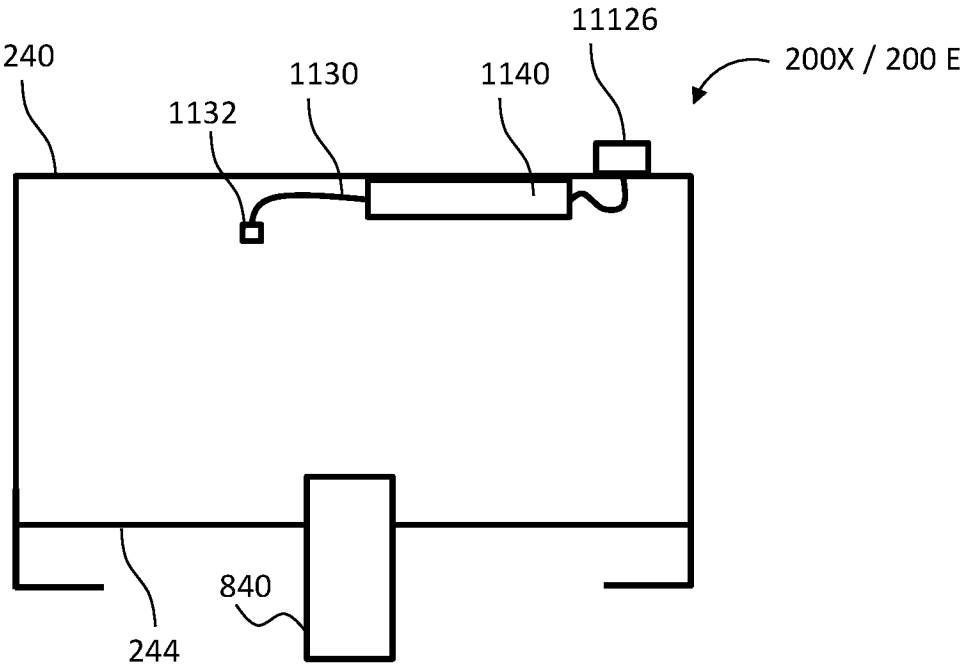
FIG. 12 is a conceptual diagram depicting an exemplary scenario of disassembly associated with the embodiment of FIG. 11.

FIG. 12 depicts the results of the removal of the actuator assembly 900 from the removable component 200 of the bone conduction device (thus depicting removable component 200X). In some embodiments, FIG. 12 represents the configuration that results during assembly of the removable component 200 of the bone conduction device, just prior to attachment of the actuator assembly 900 to the coupling assembly 840 during manufacturing (thus depicting removable component 200E for embryonic removable component). Additional details of such will be described in greater detail below. That said, in an exemplary embodiment, FIG. 12 can be said to describe the non-actuator assembly components of the removable component of a bone conduction device. (Corollary to this is that in an exemplary embodiment, the actuator assembly can be construed as a device that will actuate upon the application of an electrical signal thereto.)

Figure 13A:
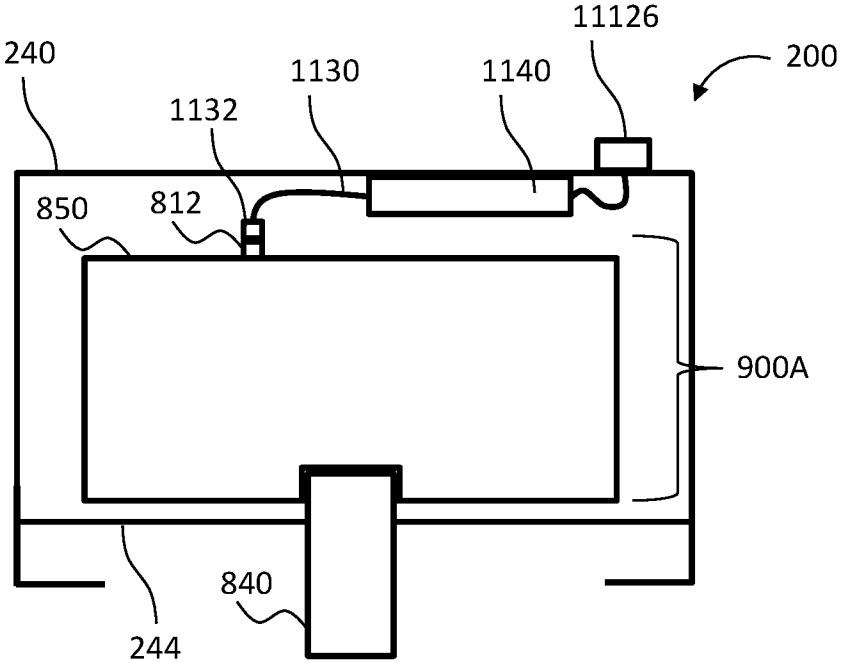
FIG. 13A is a conceptual diagram depicting additional details of the embodiment of FIG. 2.
Figure 13B:
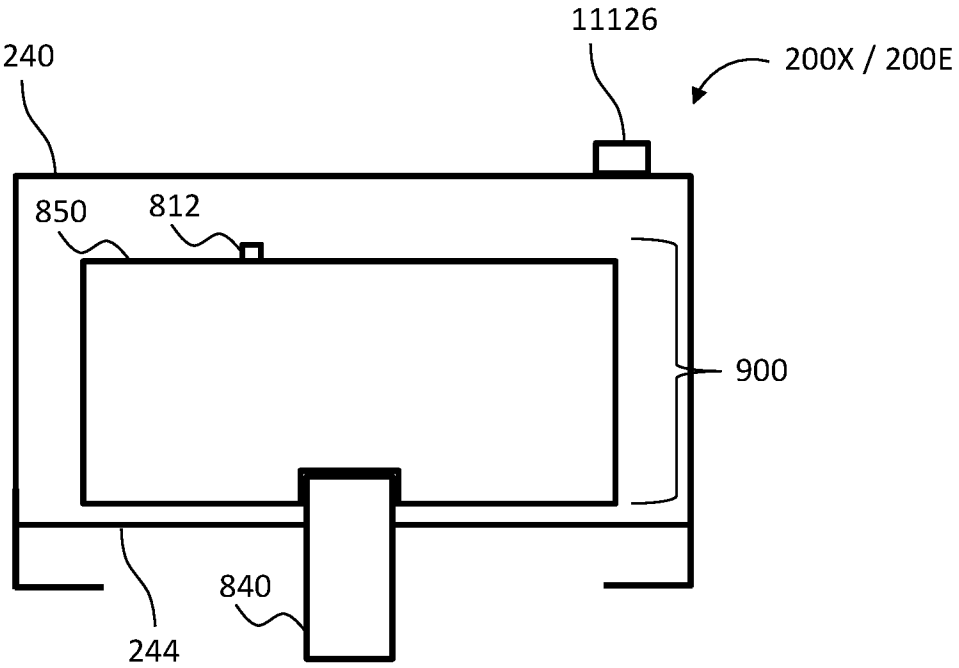
FIG. 13B is a conceptual diagram depicting an exemplary scenario of disassembly associated with the embodiment of FIG. 13A.

FIG. 13A depicts the results of installation of a new actuator assembly 900A and attachment thereto to the coupling assembly 840, along with attachment of the connector 812 to the connector 1132, thus establishing a "refurbished" removable component in the case where the actuator assembly has been replaced, and establishing a finalized or complete removable component in the case where the actuator assembly is the first insulation thereof into the housing 242 and/or the first coupling to the sound processor 1140.

While the embodiments of FIGS. 11-13A have been depicted in terms of removal and/or replacement and/or installation of the actuator assembly 900, in an alternate embodiment, the actuator assembly 900 is not replaced and the actuator assembly 900 is already located in the housing 240 or otherwise is present, and it is the sound processor 1140 that is replaced and/or installed for the first time. Along these lines, FIG. 13B depicts the embryonic removable component 200E or the removable component 200X undergoing refurbishment/maintenance where the sound processor 1140 has been removed from the removable component. In an exemplary embodiment, a new sound processor can be placed into signal communication with the actuator assembly 900 and the microphone 11126 (or a new microphone can be used as well). In an exemplary embodiment where a new sound processor is utilized, there can be utilitarian value with respect to extracting some of the algorithms or settings that were located in the old signal processor that are unique to the recipient, or otherwise settings that have utilitarian value with respect to that specific recipient and loading those algorithms or settings into the new signal processor.

Still further, in an exemplary embodiment, the sound processor and the actuator assembly are coupled together for the first time prior to insertion into the housing 1140 (which can occur in an exemplary scenario where the sound processor 1140 is mounted on the bobbin of the actuator assembly 900).

Figure 14:
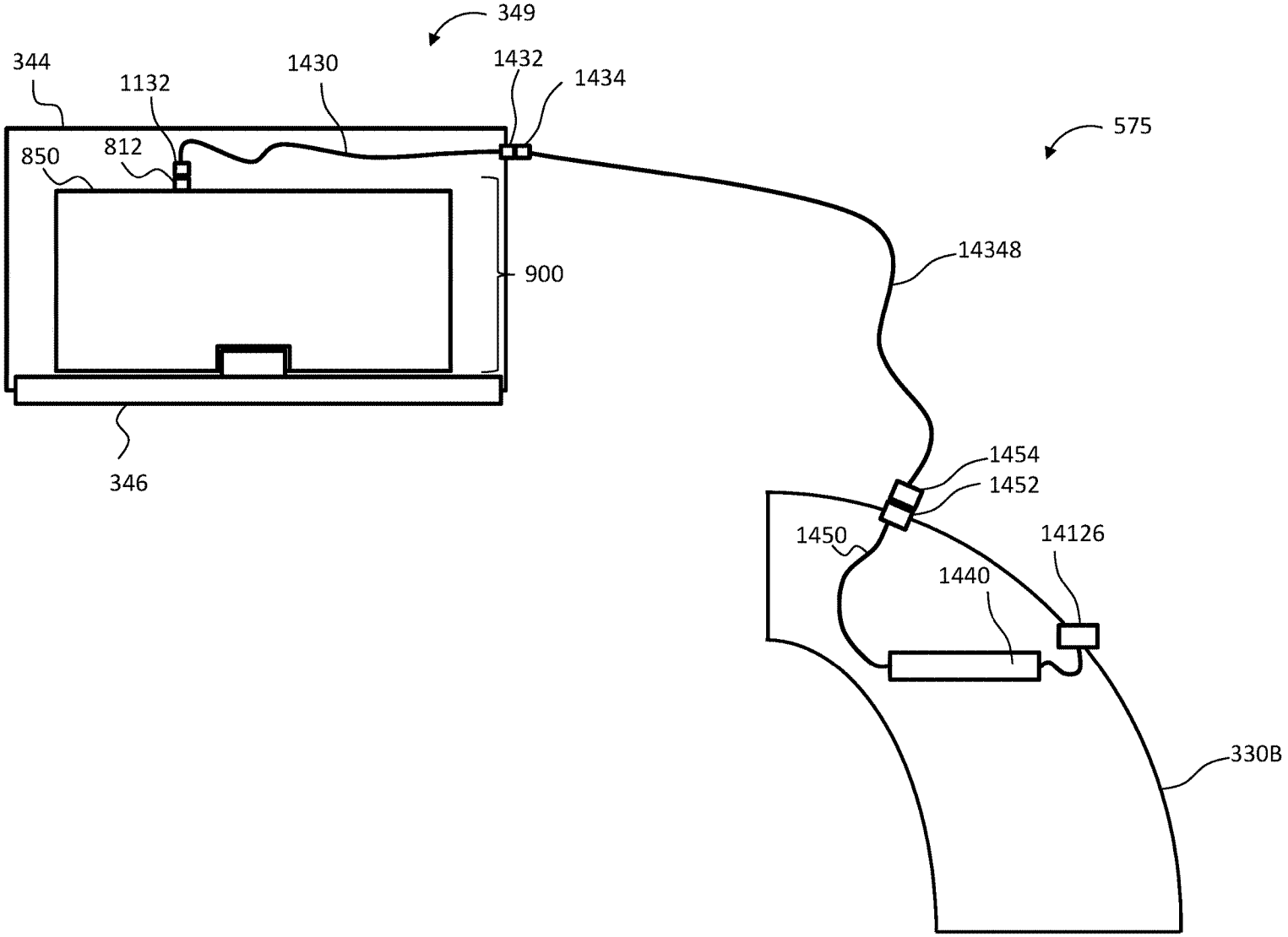
FIG. 14 is a conceptual diagram depicting additional details of the embodiment of FIG. 5A.

FIG. 14 presents an exemplary embodiment of a BTE device 575 corresponding to that of FIG. 5A. As can be seen, there is a spine 330B, which includes a sound processor 1440 that is in signal communication via electrical leads with microphone 14126 mounted on the spine 330B. While the embodiment depicted in FIG. 14 does not depict a connector coupling the electrical leads to the microphone 14126, in an alternate embodiment, such a connection is present. As can be seen, sound processor 1440 is an electrical communication with connector 1452 via lead 1450. This connector is removably connected to connector 1454, which is connected to lead/cable 14348 (corresponding to cable 348 of the embodiment of FIG. 5A). Lead/cable 14348 is coupled to connector 1434 which enables removable disconnectable connection to connector 1432 which is mounted to a housing 344 of the remote vibrator actuator unit 349. That said, in alternate embodiments, at least one end of the lead/cable 14348 does not include a connector per se that enables ease of disconnection between the cable 14348 and the respective component to which the cable is attached.

Connector 1432 is in signal communication via lead 1430 with connector 1132. Connector 1132 is disconnectably connected to actuator assembly 900 as can be seen. Actuator assembly 900 is connected to plate 346 such that when actuator assembly 900 vibrates as a result of signals provided from the signal processor 1440 via cable 14348, the vibrations are transferred to the plate 346 which interfaces with the skin of the recipient such that the vibrations are transferred into the skin of the recipient and ultimately to bone of the recipient to evoke a hearing percept via bone conduction.

It is briefly noted that while the embodiments of FIGS. 11 and 14 have focused on utilizing the actuator assembly 900, in alternate embodiments, the actuator assembly 800 and/or the actuator assembly 1000 can be utilized—any arrangement of an actuator assembly they can have utilitarian value can be utilized in at least some exemplary embodiments.

Figure 15:
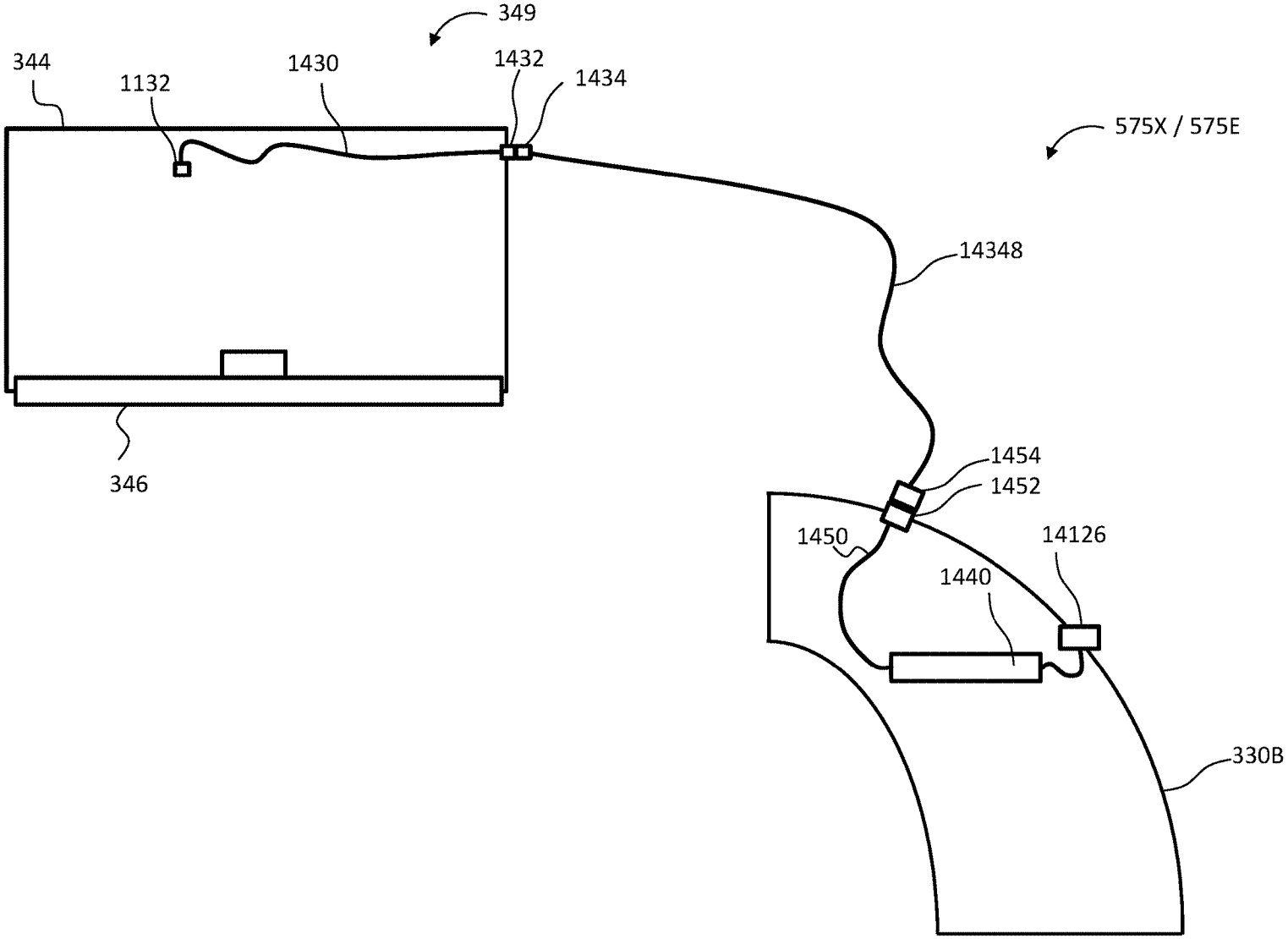
FIG. 15 is a conceptual diagram depicting an exemplary scenario of disassembly associated with the embodiment of FIG. 14.
Figure 16:
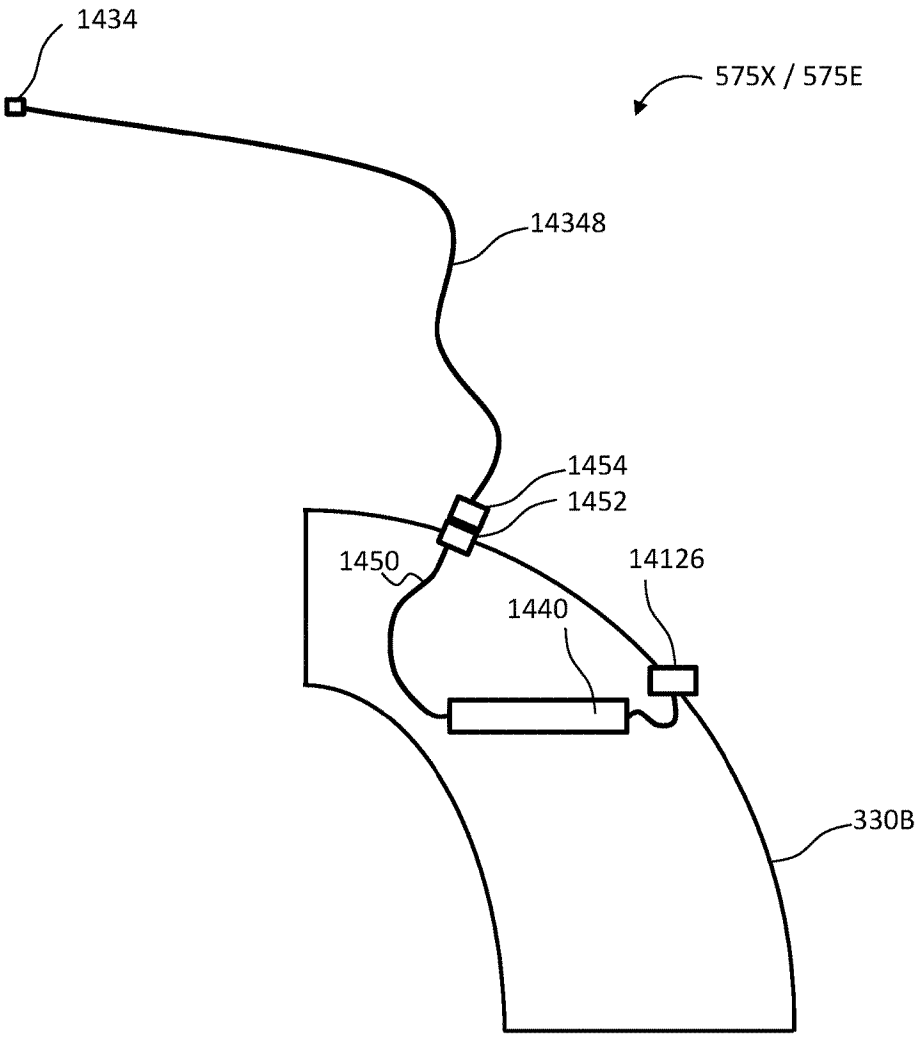
FIG. 16 is a conceptual diagram depicting another exemplary scenario of disassembly associated with the embodiment of FIG. 14.
Figure 17:
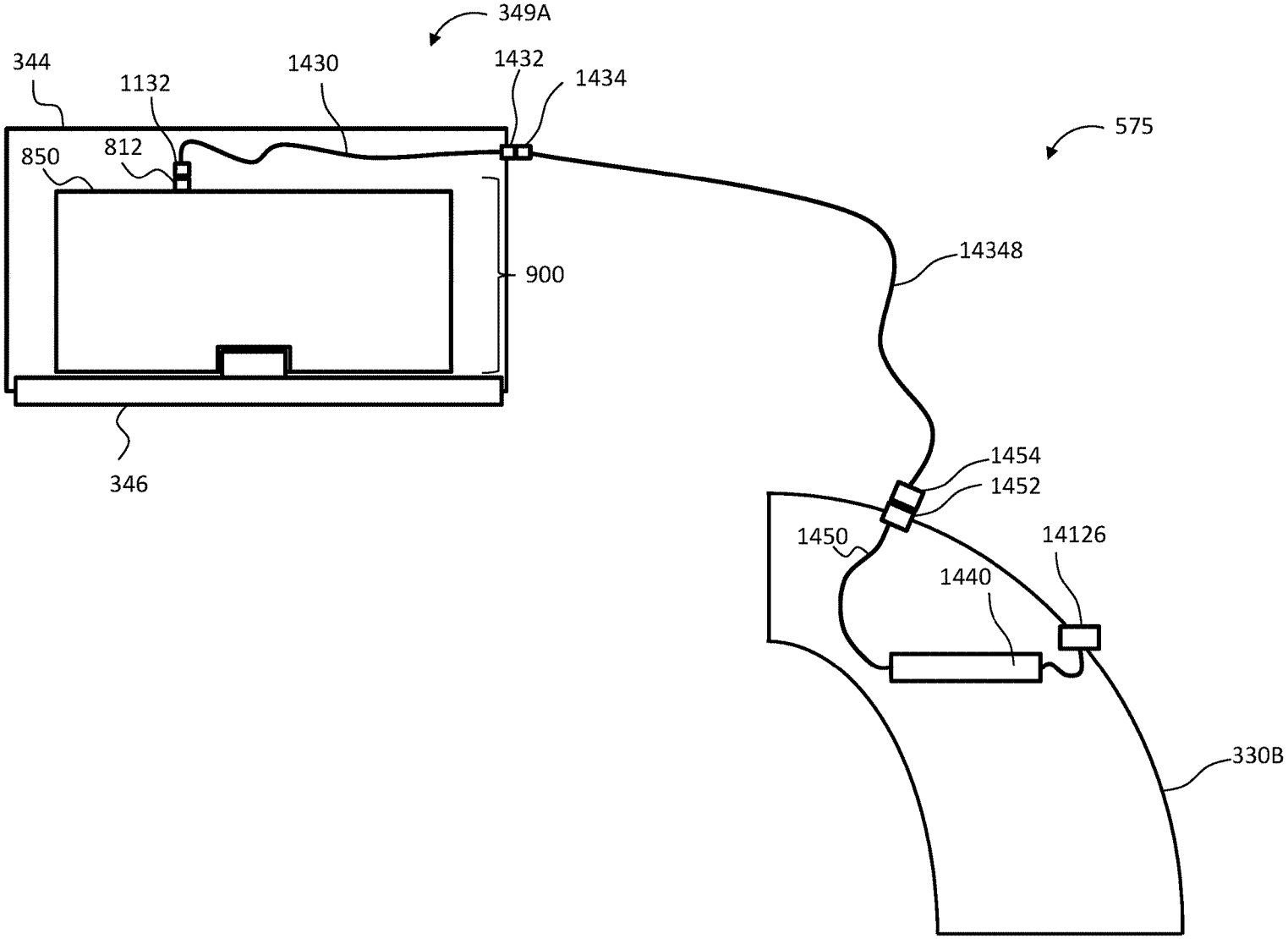
FIG. 17 is a conceptual diagram depicting an exemplary scenario of a modification to the embodiment of FIG. 14.

Consistent with the teachings detailed above, in an exemplary embodiment, there can be a scenario where the actuator 900 is to be replaced for one reason or another (e.g., failure, degraded performance due to age or a traumatic even, obsolescence, etc.). In an exemplary embodiment, this can entail removing the actuator assembly 900 from the housing 344 of the remote vibrator actuator unit 349, the results of which can be seen in FIG. 15 (showing transition status BTE device 575X (or, in the case where the actuator assembly 900 is to be attached to the plate 346 otherwise placed in the signal communication with the spine 330B for the first time, showing embryonic BTE device 575E), and installing a new actuator 900A therein. That said, in an alternate embodiment, it is the entire removable vibrator actuator unit 349 that is replaced. For example, the removable vibrator actuator unit 349 of FIG. 14 can be disconnected from connector 1432 and removed from the BTE device 575, the results of which can be seen in FIG. 16 (showing transition status BTE device 575X (or, in the case where the remote vibrator actuator unit 349 is to be attached or otherwise placed in the signal communication with the spine 330B for the first time, showing embryonic BTE device 575E)). Thus, FIG. 17 depicts the BTE device 575 after replacement of the remote vibrator actuator unit 349 with a new remote vibrator actuator unit 349A. FIG. 17 also depicts the results of simply replacing the actuator assembly 900 with a new actuator assembly 900A while keeping the housing 344 and/or the plate 346 that was previously utilized with the old actuator assembly 900.

Figure 18:
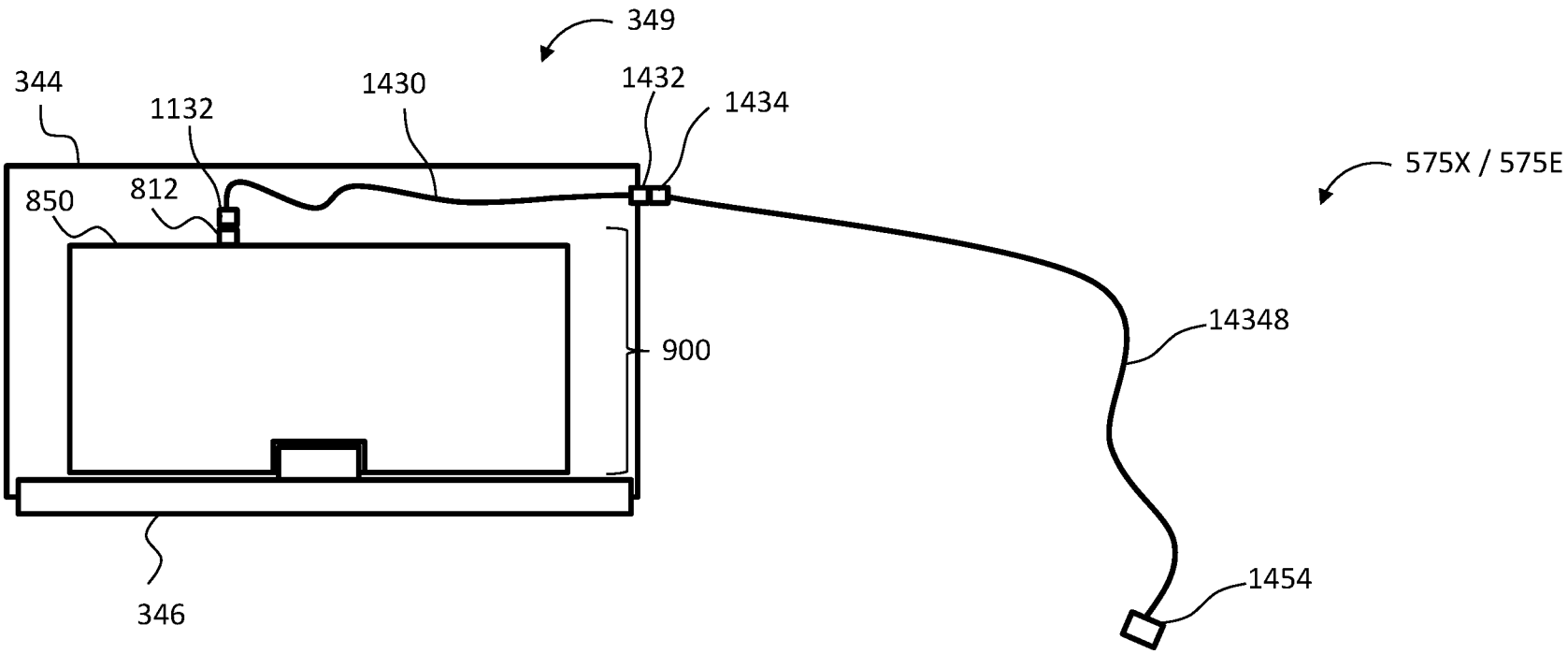
FIG. 18 is a conceptual diagram depicting another exemplary scenario of disassembly associated with the embodiment of FIG. 14.

Consistent with the teachings detailed above where it is the sound processor that is replaced instead of the actuator assembly, FIG. 18 depicts the BTE device 575X in a transition state where the spine 330B is disregarded for whatever reason and a new spine 330B is to be connected to the connector or 1454, which new spine 330B includes a new sound processor (again, which could be configured with settings and/or algorithms that have utilitarian value that were developed for the old sound processor). FIG. 18 also depicts the embryonic BTE device 575E prior to attachment/connection to the spine 330B during manufacturing of the BTE device 575, and also that which could be the case in a scenario where the two components are delivered separately to a recipient and/or an audiologist or the like, and the recipient and/or audiologists can attach the connector 1454 to the spine for the first time.

Figure 19:
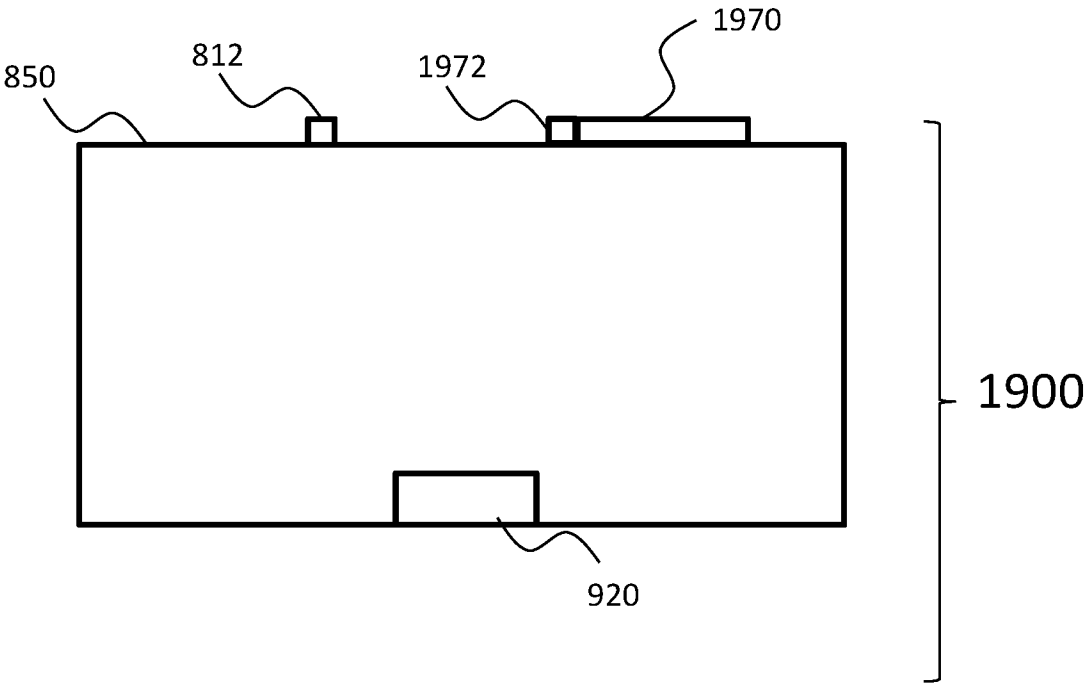
FIG. 19 depicts a conceptual diagram depicting an exemplary actuator assembly according to an exemplary embodiment.

FIG. 19 conceptually depicts an exemplary embodiment of an actuator assembly 1900 which corresponds to the actuator assembly 900 detailed above with the addition of a memory assembly comprising memory 1970 and connector 1972. As can be seen, the actuator assembly 1900 thus comprises a transducer including a memory device that is directly attached to the transducer. In an exemplary embodiment, this memory device is a machine-readable memory device in that the data stored thereon requires a machine to read such data.

In an exemplary embodiment, the memory device (sometimes herein referred to simply as a memory, and in other instances, a memory unit—any disclosure herein of one corresponds to a disclosure of the others unless otherwise noted) is a device that stores electronically encoded data. In an exemplary embodiment, which may or may not be mutually exclusive from the aforementioned embodiment, the data enables electronic data storage, which requires at least one of electrical power to store or retrieve the data. In an exemplary embodiment, the data stored in the memory device/the memory device is such that the device does not require vision and a brain to read the data. In an exemplary embodiment, the machine-readable memory device is a memory chip. The memory device can be or otherwise include a semiconductor that utilizes volatile and/or non-volatile microchips. In an exemplary embodiment, the memory device can be a volatile RAM microchip. In an exemplary embodiment, the memory device can be a non-volatile RAM microchip. In an exemplary embodiment, the memory device can be a floating gate transistor array. In an exemplary embodiment, the machine-readable memory device can be a memory card and/or a flash card. Thus, in an exemplary embodiment, memory device can be a solid-state nonvolatile computer storage medium. In an exemplary embodiment, the machine-readable memory device can be a magnetic storage medium. In an exemplary embodiment, the memory device is such that the data stored thereon can be erased. In an exemplary embodiment, the memory device is such that the data stored thereon cannot be erased. Any arrangement that can enable the teachings detailed herein and/or variations thereof to be practiced can be utilized as a machine-readable memory device.

In an exemplary embodiment, the machine-readable memory device is a device that presents a machine-readable medium (sometimes referred to as an automated data medium) such that the data stored therein is stored in a format readable by a mechanical device rather than human readable.

Figure 20A:
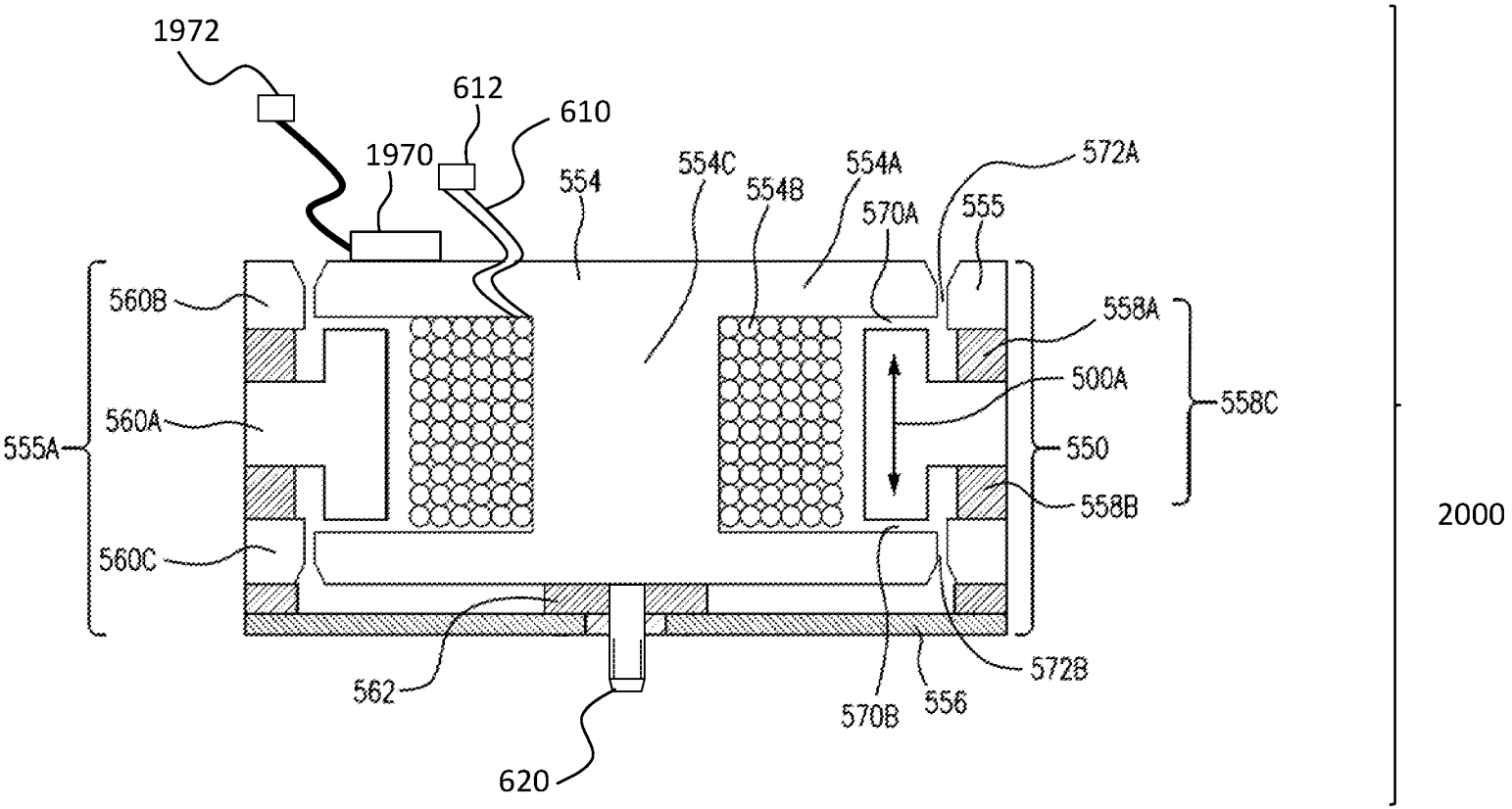
FIG. 20A depicts a quasi-conceptual diagram depicting another exemplary actuator assembly according to an exemplary embodiment.

In an exemplary embodiment, the machine-readable memory device is a barcode. In an exemplary embodiment, the machine-readable memory device contains OCR data. Additional details of this exemplary embodiment can be seen in FIG. 20A, which depicts the exemplary actuator assembly 2000 (corresponding to actuator assembly 1900 of FIG. 19), where a memory unit 1970 is mounted on bobbin 554 in general, and the arm 554A of the bobbin in particular, although in other embodiments, the memory 1970 can be located elsewhere, such as on the seismic mass of the actuator assembly, above the bobbin core 554C, in the bobbin (e.g., a portion of the arm 554A and/or core 554C could be hogged out to make room for the memory 1970 and/or the connector 1972). As can be seen, the connector 1972 is depicted as being in signal communication with the memory unit 1970 via a flexible lead. In an alternate embodiment, the connector 1972 can be hard mounted to the memory 1970 and/or can be hard mounted to the bobbin or to another component of the actuator assembly. It is also noted that this is also the case with respect to connector 612.

Figure 20B:
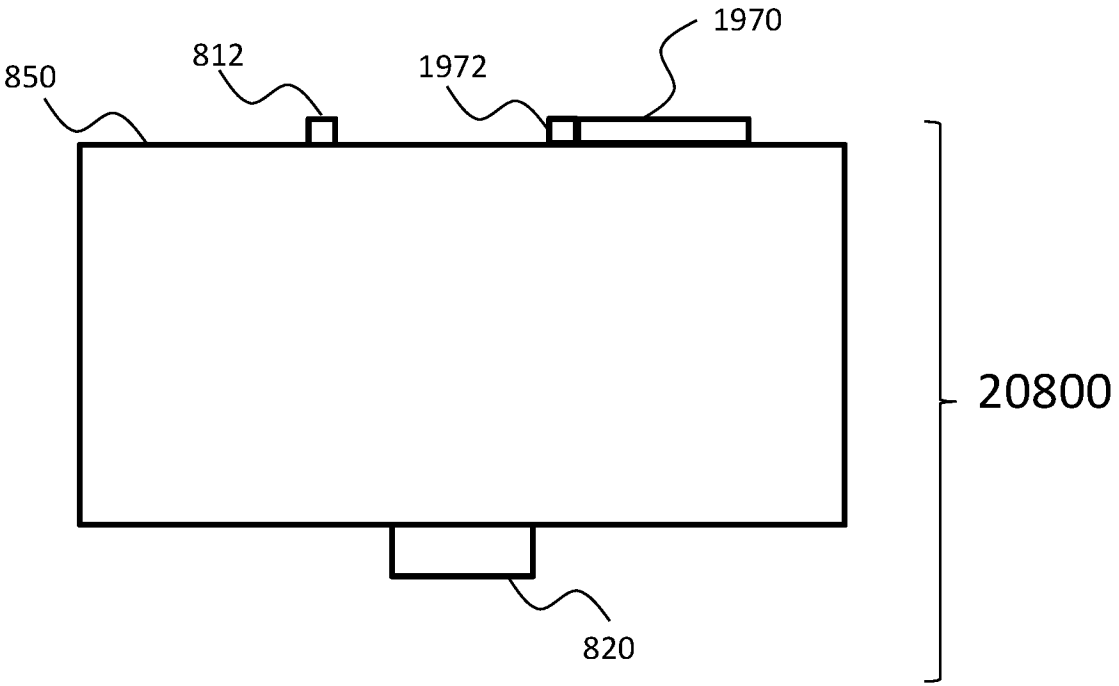
FIG. 20B depicts a conceptual diagram depicting another exemplary actuator assembly according to an exemplary embodiment.
Figure 20C:
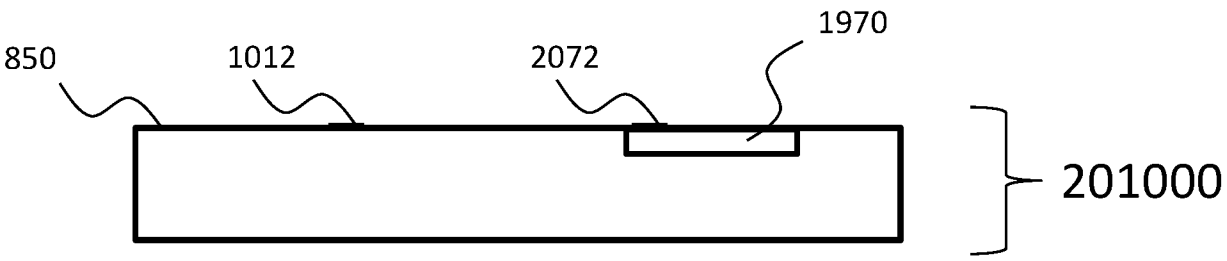
FIG. 20C depicts a conceptual diagram depicting another exemplary actuator assembly according to an exemplary embodiment.

Note that the concept of FIG. 19 can be applied to the other exemplary actuator assembly detailed herein. In this regard, FIG. 20B depicts an exemplary actuator assembly 20800 corresponding to actuator assembly 800 above, where memory 1970 and connector 1972 have been added in a manner concomitant with the embodiment of FIG. 19. FIG. 20C depicts another exemplary actuator assembly 201000 corresponding to actuator assembly 1000 above, where memory 1970 has been added. However, instead of a dedicated connector, a bonding pad 2072 is included in the actuator assembly. In an exemplary embodiment, electrical leads are soldered to bonding pad 2072 to place the memory 1970 into signal communication with the other components of the prosthesis. It is noted that any disclosure herein of an actuator assembly or the like corresponds to a disclosure of an actuator assembly that includes a memory (which can include a connector). Further, it is noted that any disclosure herein of an actuator assembly corresponds to a disclosure of an actuator assembly that includes a memory which is in signal communication or which can be placed into signal communication with another component of the prostheses. It is also noted that any disclosure herein of an actuator assembly corresponds to a disclosure of an actuator assembly that includes a memory which can be placed into signal communication with any other component that can have utilitarian value with doing so. Some additional details and utilitarian features of utilizing the memory will now be described.

Figure 21:
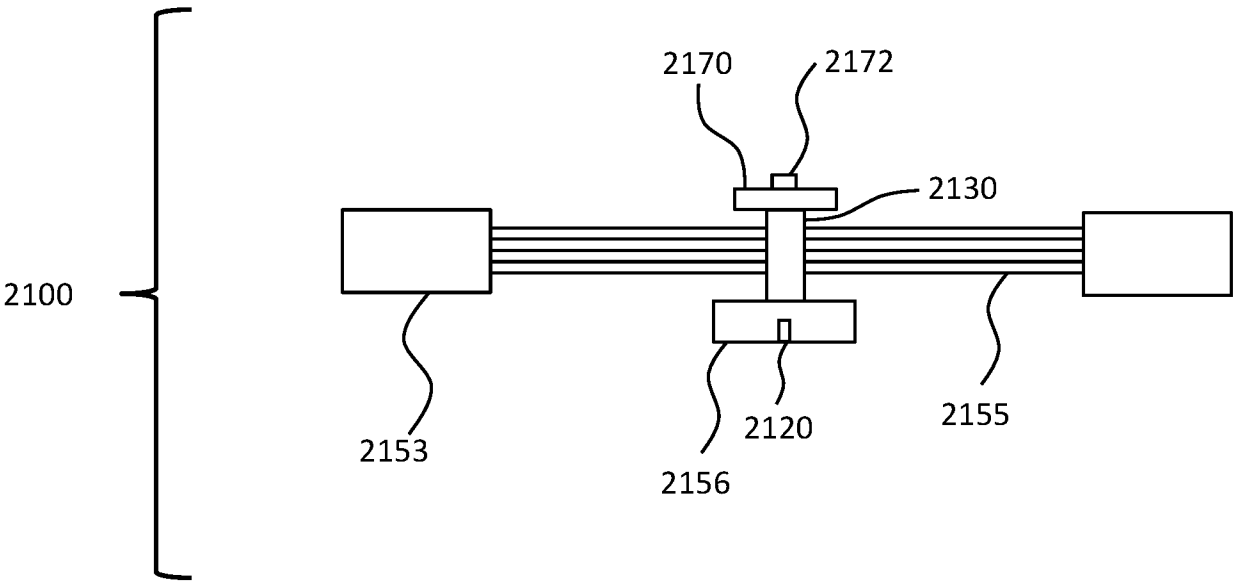
FIG. 21 depicts a conceptual diagram depicting another exemplary actuator assembly according to an exemplary embodiment.
Figure 22:
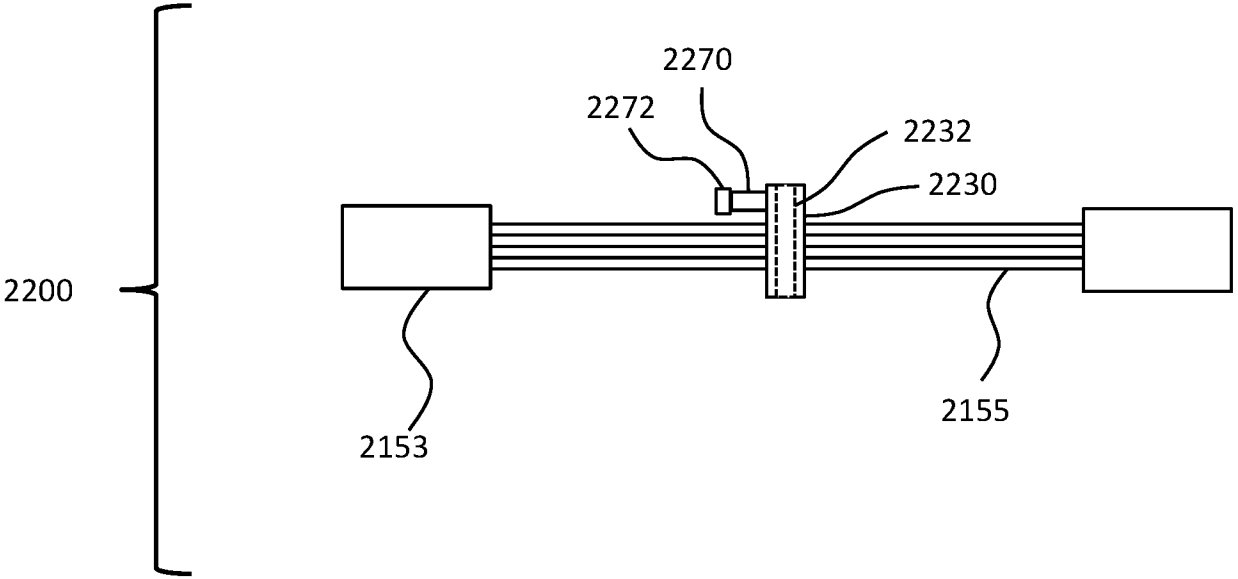
FIG. 22 depicts a conceptual diagram depicting another exemplary actuator assembly according to an exemplary embodiment.

As noted above, some exemplary embodiments can utilize piezoelectric transducers. In this regard, FIG. 21 depicts an exemplary actuator assembly 2100 that includes seismic mass 2153 supported by piezoelectric material 2155. In an exemplary embodiment, upon the application of an electrical signal to the piezoelectric material 2155, the piezoelectric material expands and/or contracts so as to vibrate the mass 2153 to generate vibrations. In this exemplary embodiment, actuator assembly 2100 includes chassis 2156 that includes a bottom portion thereof with a receptacle 2120 (which in some embodiments, can be threaded) that enables removable attachment to a housing or the like (or, in some other embodiments, enables only attachment to a housing or the like, where it is not intended for the actuator to ever be removed from the housing—an exemplary embodiment where such could be the case is the housing 454 of FIG. 4, where the actuator of FIG. 21 corresponds to the vibrating actuator of that figure, and the entire housing 454, including the actuator, could be removed and replaced with a new housing and new actuator). The chassis 2156 extends through the piezoelectric material to a top location thereof via support stem 2130 where a memory 2170 is located thereatop, and the connector 2172 is located thereon. It is noted that in at least some alternate embodiments, where, for example, a screw or bolt extends from the top of the actuator assembly to the bottom of the actuator assembly, the memory can be located to one side of the stem 2130. Indeed, FIG. 22 depicts an exemplary embodiment where the stem 2230 extends through the piezoelectric material and supports the piezoelectric material 2155, where the stem 2230 includes a hollow portion 2232 that completely extends from one side to the other side of the stem that enables a bolt or the like to be extended through the stem 2230, which bolt can be utilized to attach the housing in which the actuator 2200 is located to a bone fixture of the recipient. As can be seen, memory unit 2270 is attached to the side of the stem 2230 so as to provide a clear passageway for the bolt to extend through stem 2230. A connector 2272 is located on one side of the memory 2270 (the opposite side from the side of the memory 2270 that is attached to the stem 2230). Thus, as can be seen, an exemplary embodiment includes a transducer that includes a seismic mass 2153 and a stationary structure, such as stem 2130 with respect to the embodiment of FIG. 21 (and bobbin 554 with respect to the embodiment of FIG. 20), to which the seismic mass is movably attached (here, with respect to the embodiment of FIG. 21, via the piezoelectric actuator 2155, and with respect to the embodiment of FIG. 20, via spring 556). Still further as can be seen, the memory 2170 (or the memory 1970 with respect to the embodiment of FIG. 20) is directly attached to the stationary structure.

Figure 23:
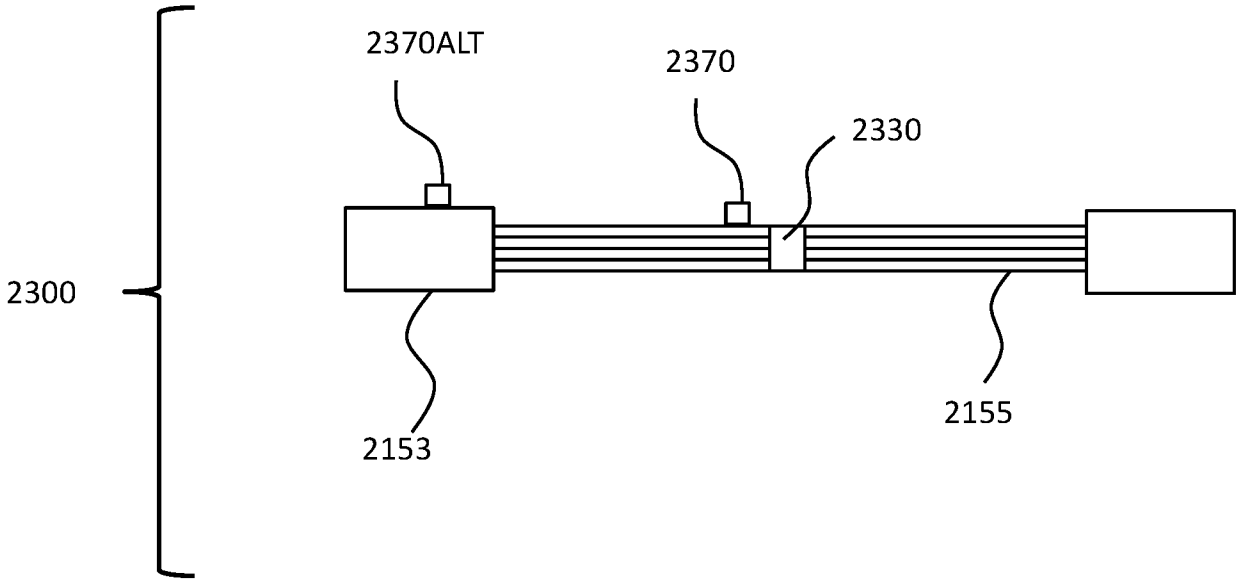
FIG. 23 depicts a conceptual diagram depicting another exemplary actuator assembly according to an exemplary embodiment.

FIG. 23 depicts an alternate embodiment of an actuator assembly 2300 where the memory unit 2370 is located or otherwise mounted on to the piezoelectric material 2155. FIG. 23 also depicts an alternate location of the memory unit 2370ALT, where the memory unit is located on the seismic mass 2153. The embodiment depicted in FIG. 23 does not show a mounting component or support for the piezoelectric material 2155, instead depicting the passage 2330 through the piezoelectric material through which a bolt or a fixture or the like can be extended so as to mount the piezoelectric material 2155 to the chassis or the like.

As can be seen, there is no connector presented in the embodiment of FIG. 23 vis-à-vis the memory. In an exemplary embodiment, the memory 2370 can be accessed wirelessly or the like such as via an RFID type arrangement. Some additional details of this will be described in greater detail below. However, it is briefly noted that such a configuration can have utilitarian value with respect to not having to manually or physically connect the memory 2370 to another connector, which could result in damage to the relatively brittle piezoelectric material 2155. Such also has utilitarian value with respect to eliminating any need for a wired connection that would extend from a component that moves during actuation of the actuator, which wired connection could interfere with or otherwise alter the resonant frequency or the like of the actuator.

As noted above, the teachings detailed herein include a transducer that is an actuator (and can be an actuator assembly) that is devoid of any other electronic components except for the electronic components that induce actuation forces in the transducer and input-output apparatuses thereof (e.g., connector 612) if present in the device to which the actuator is apart. That said, in some alternate embodiments that utilize the memories detailed herein, such embodiments can include a transducer that is an actuator (and can be an actuator assembly) that is devoid of any other electronic components except for the memory unit (and any connectors thereof if such is present in the device) and electronic components that induce actuation forces in the transducer and input-output apparatuses thereof (e.g., connector 612) if present in the device of which the actuator is apart.

To be clear, it is noted that embodiments include the addition of the memory unit to any of the actuators and/or transducers detailed herein and/or variations thereof as those actuators and/or transducers are utilized herein and/or variations thereof. Thus, any disclosure herein of an actuator and/or a transducer corresponds to a disclosure of an actuator and/or transducer that includes the memory apparatuses as detailed herein and as detailed as being used herein and/or variations thereof.

Some exemplary utilitarian features with respect to utilization of the memory in combination with the transducer assembly will now be described.

This operational performance data can have utilitarian value with respect to the ability to store information having utilitarian value with respect to fine-tuning or otherwise more precisely controlling the output of the transducer assembly when used. In this regard, in an exemplary embodiment, the data stored in the memory of the actuator assembly can be transferred or otherwise read by the bone conduction device, and the sound processor can be provided with such data such that the output of the sound processor to the actuator will be modified relative to that which might otherwise be the case in the absence of such data so as to achieve a different output of the actuator assembly relative to that which might otherwise be the case in the absence of such data stored in the memory and/or such data being provided to the sound processor of the hearing prosthesis. Some additional details of the processing algorithms utilized by the sound processor of the hearing prosthesis to harness the utilitarian value with respect to the data stored in memory will be described below. First however, an exemplary structural arrangement that can be utilized to harness or otherwise obtain the data stored in the memory will now be described.

Figure 24:
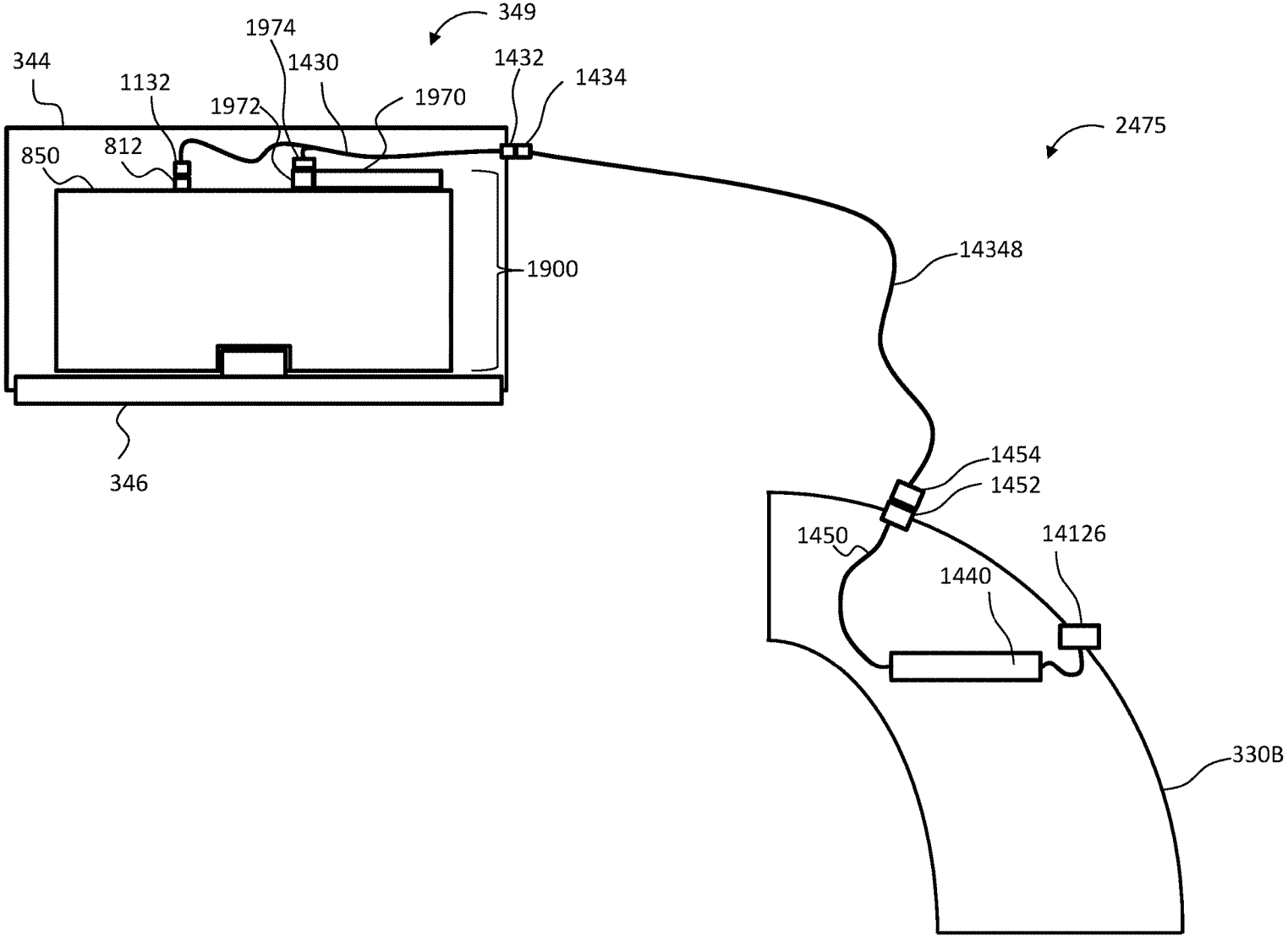
FIG. 24 depicts a conceptual diagram depicting another exemplary embodiment of the embodiment of FIG. 5A.

FIG. 24 depicts an exemplary BTE device 2475. BTE device 2475 can correspond to BTE device 575 detailed above and/or variations thereof, with the exception that the actuator assembly used thereby includes the memory or other type of storage device according to the teachings detailed herein. In particular, as can be seen, the actuator assembly located in the remote vibrator actuator unit 349 includes actuator assembly 1900 instead of actuator assembly 900. It is briefly noted that any disclosure of an actuator assembly as used herein also corresponds to a disclosure of an actuator assembly including the memory. As can be seen, the remote vibrator actuator unit 349 includes a connector 1132 that is configured to provide an electrical signal to the actuator assembly 1900 to actuate the actuator assembly according to a signal outputted by the sound processor 1440 to evoke a hearing percept via actuation of the actuator. In addition, the remote vibrator actuator unit 349 further includes connector 1974 connected to connector 1972, which, as detailed above, is a connection that is connected to memory 1970. Connector 1974 is connected to the lead 1430 via a sub lead as can be seen. Thus, connector 1974 is in signal communication with the sound processor 1440 via cable 14348. In an exemplary embodiment, the sound processor 1440 can read the memory 1970/extract the data stored in the memory 1970 when the connector 1974 is connected to the connector 1972. That is, connector 1974, in combination with the lead assembly detailed herein and/or variations thereof, enables signal communication between the memory 1970 and the sound processor 1440.

That said, it is noted that connector 1974 can be in signal communication with another component located within the spine 330B which in turn can be in signal communication with the sound processor 1440. By way of example only and not by way of limitation, in an exemplary embodiment where the BTE device includes a separate controller separate from the sound processor, this controller can read the data stored in the memory 1970. It is noted that any disclosure herein of a sound processor corresponds to an integrated processor that includes a controller to vary the sound processing strategies thereof as well as a sound processor and a controller that is separate from the sound processor, where the controller controls the sound processor to process sound according to various strategies.

Figure 25:
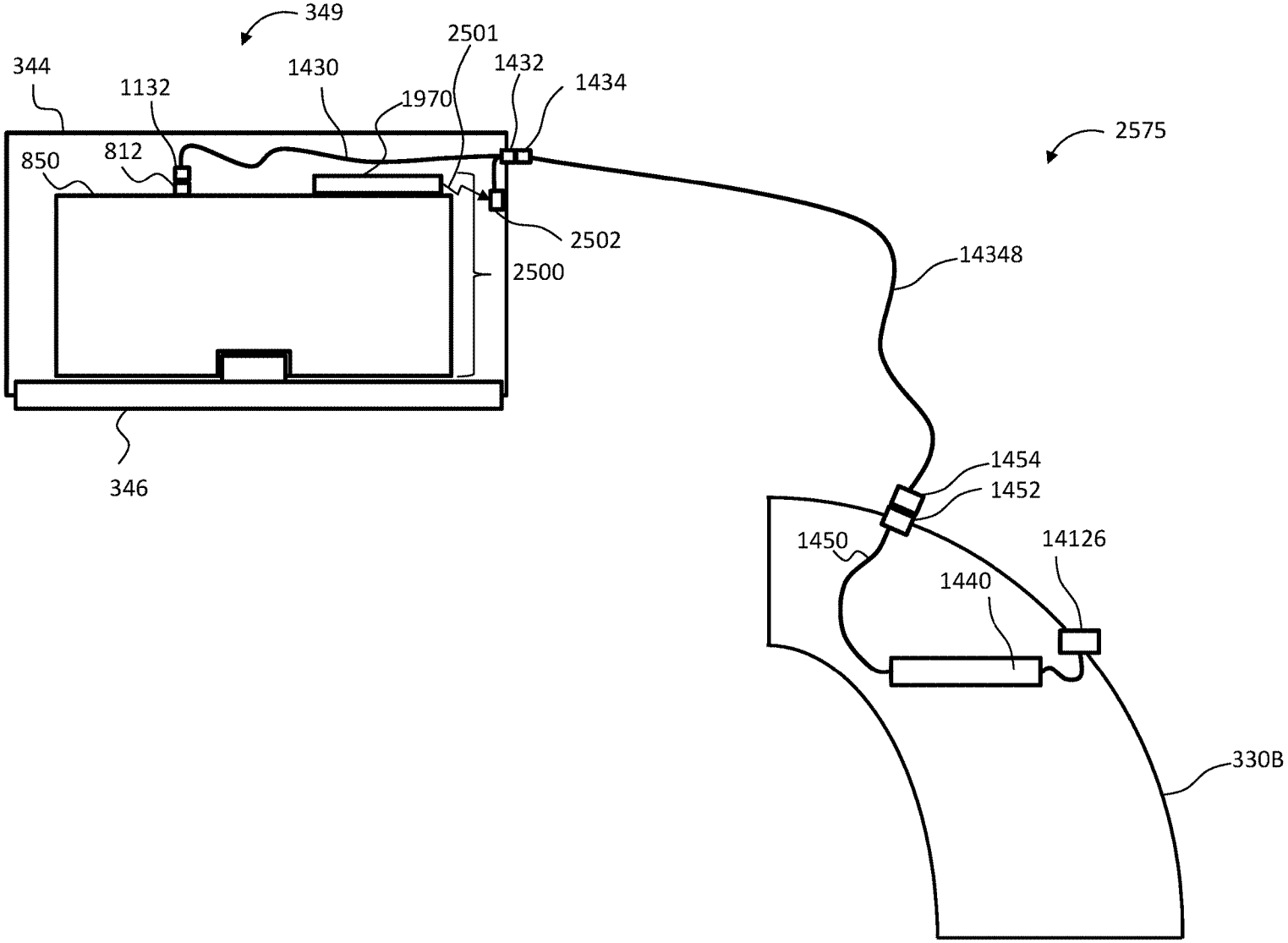
FIG. 25 depicts a conceptual diagram depicting another exemplary embodiment of the embodiment of FIG. 5A.
Figure 26A:
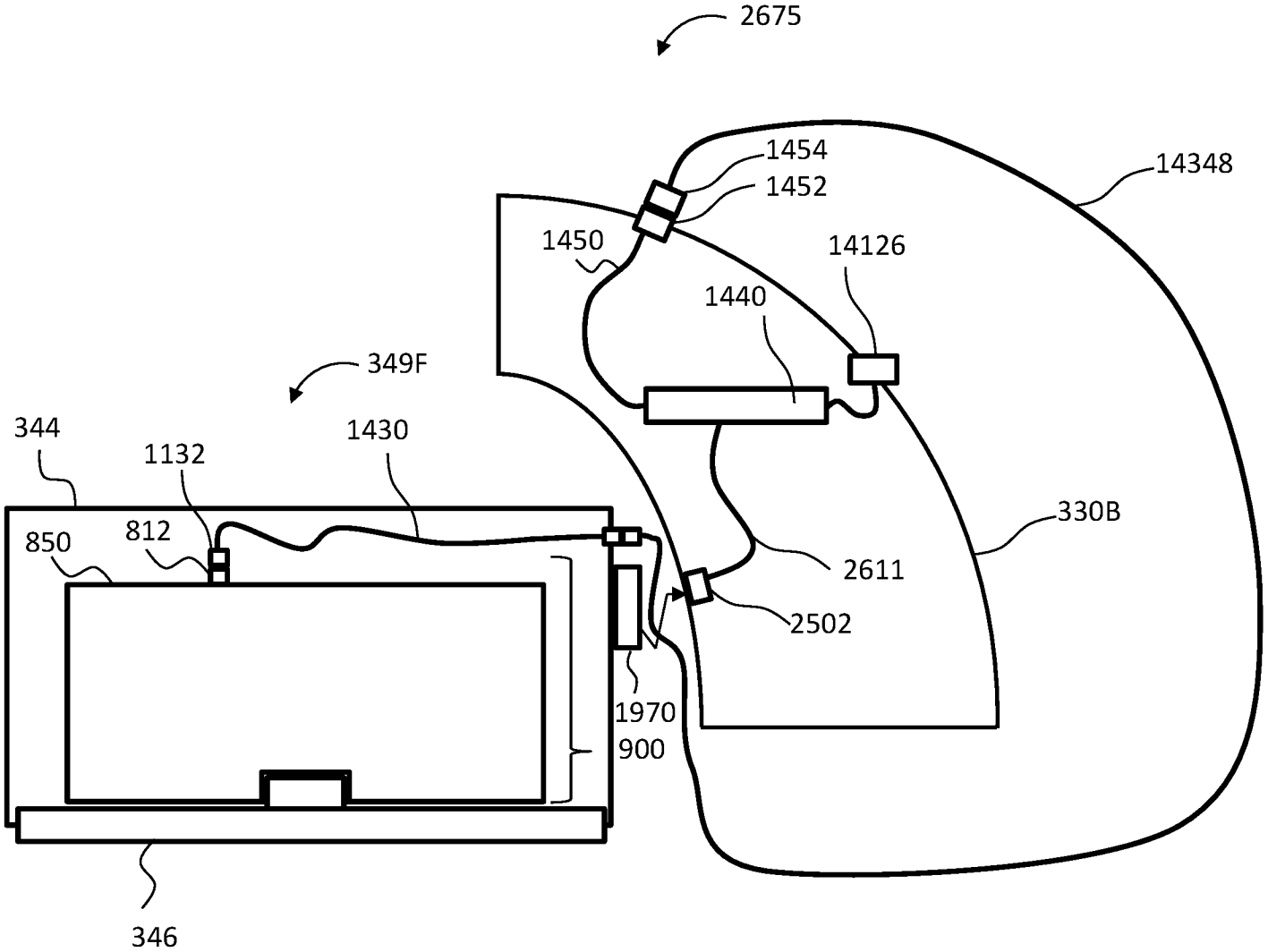
FIG. 26A depicts a conceptual diagram depicting another exemplary embodiment of the embodiment of FIG. 5A.
Figure 26B:
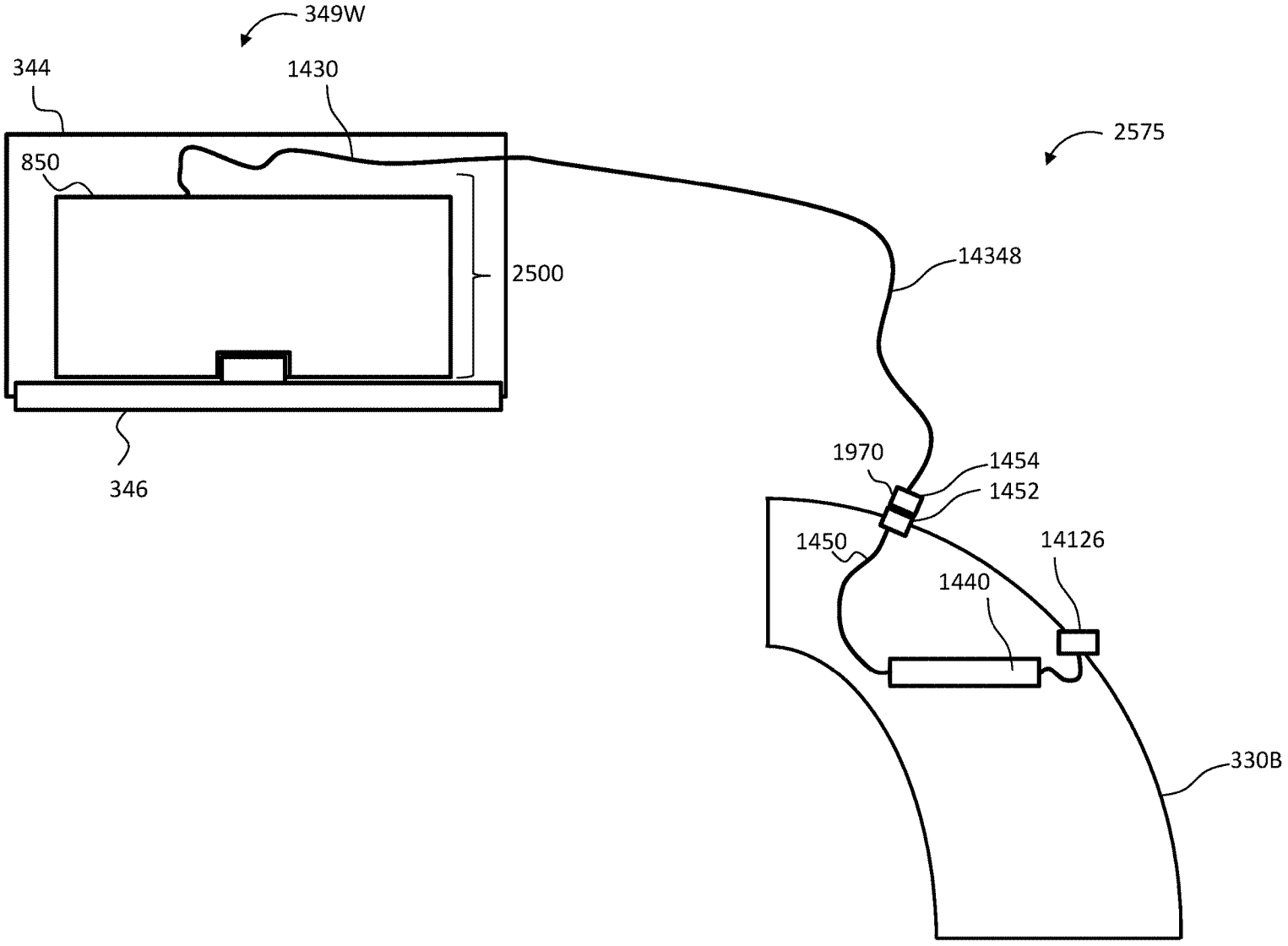
FIG. 26B depicts a conceptual diagram depicting another exemplary embodiment of the embodiment of FIG. 5A.

FIG. 25 depicts an alternate embodiment of the BTE device 2575, which corresponds to the BTE device 2475 detailed above, with the exception that a wireless communication system is utilized to communicate between memory 1970 and interrogator 2502 via RF link 2501. In this regard, interrogator 2502 is in signal communication with connector 1432 via electrical lead as can be seen. The interrogator 2502 can interrogate the memory 1970 and obtain data stored in the memory via the link 2501. That said, in an alternative embodiment, an infrared communication system can be utilized to establish the link between the memory 1970 and the interrogator 2502. Still further, in an exemplary embodiment, the interrogator can be located in spine 330B, which is depicted by way of example only in FIG. 26A. Here, in an exemplary embodiment, to access the memory stored in memory 1970, the spine 330B is moved proximate to the remote vibrator actuator unit 349 such that the interrogator 2502 is also proximate to the memory 1970 so that the wireless link can be established between the memory and the interrogator 2502 (whereby the memory can include a transponder or the like to enable the transfer of the data stored in the memory or otherwise embodied in the memory). Owing to the flexibility of cable 14348, the spine 330B can be brought into close proximity with the remote vibrator actuator unit so as to establish the wireless link. As can be seen, in the embodiment of FIG. 26A the memory 1970 is located on the outside of the housing 344. Thus, in an exemplary embodiment directed to an actuator assembly including the memory, the actuator assembly would also include the entire remote vibrator actuator unit 348F. Indeed, in some exemplary embodiments, it is the entire remote vibrator actuator unit that is replaced, whether such is a result of the connection between the cable 14348 and the housing 344 or such as a result of the connector 1454. Thus, in an exemplary embodiment, replacement of the remote vibrator actuator unit also includes replacement of the cable 14348, at least for such embodiments that are directed towards a cable that is generally unremovable from the housing 344 of the remote vibrator actuator unit. In this regard, FIG. 26B depicts such an exemplary embodiment, where the cable 14348 is for all intents and purposes hard mounted to the remote vibrator actuator unit.

While the embodiments detailed above have focused on the utilization of an RF link and an infrared link to establish a wireless link, other types of wireless links can be utilized, such as magnetic links, etc. Any wireless link that can enable the information/data of the memory 1970 to be accessed so that such data/information can be used in accordance with the teachings detailed herein and/or variations thereof, can be utilized in at least some exemplary embodiments. While not mutually exclusive to this embodiment, this is an exemplary embodiment where the memory unit 1970 is also embodied in the connector 1454. In this regard, the remote vibrator actuator unit 349W is a completely replaceable assembly in and of itself, including the cable 14348. That is, in an exemplary embodiment associated with replacing the actuator assembly, the entire remote vibrator actuator unit 3409W, which includes the cable 14348, is replaced by a new remote vibrator actuator unit which also includes a new cable. The cable is connected to the connector 1454 utilizing the connector of this new cable. The connector 1454 is configured so as to play a dual role as a connector and the memory 1970. That said, in an exemplary embodiment, the memory can be a separate component of the connector. In any event, connection of connector 14542 enables the processor 1440 or other pertinent component to read or otherwise access the data in the memory 1970.

In view of the embodiments of FIGS. 24-26 (and the other FIGS. disclosed as including the memory), it is to be understood that an exemplary embodiment includes a hearing prosthesis, such as a bone conduction device and/or a middle ear implant and/or a conventional acoustic hearing aid, including an actuator assembly. The actuator assembly can correspond to an electromagnetic actuator assembly and/or a piezoelectric actuator assembly, or any other actuator assembly that can be utilized to establish vibration for a bone conduction device, or any actuator that can be utilized to move portions of a middle ear and/or the cochlea via the utilization of a middle ear implant, or any actuator that can be utilized as a speaker/receiver of an acoustic hearing aid. According to the teachings detailed herein, there is a chassis supporting the actuator assembly. The chassis can include the interface plate 346 is seen in FIG. 24, can include in the housing 454 as seen in FIG. 2, can include the coupling assembly 240 as seen in FIG. 2, etc. This chassis can also correspond to a tube in which the electromagnetic actuator of a middle ear implant is located or otherwise supported, where the housing of an in the ear component of a conventional hearing aid, etc. in accordance with the teachings detailed herein, the actuator assembly is configured to vibrate when a current is applied thereto such that the first apparatus of the actuator assembly (e.g., the component including the seismic mass) vibrates relative to a second apparatus of the actuator assembly (e.g., the bobbin of an electromagnetic actuator, the support of the piezoelectric actuator that supports the piezoelectric material etc.). In accordance with the teachings detailed herein, the actuator assembly retains data, such as electronic data, related to an operational performance of the actuator assembly. In an exemplary embodiment, this is achieved via the memory units detailed herein that are part of the actuator assembly.

Still further in accordance with the teachings detailed herein, the hearing prosthesis further includes a processor that is remote from the actuator assembly. In an exemplary embodiment, this can correspond to processor 1440 of FIG. 24 or processor 1140 of FIG. 13A. Consistent with the teachings detailed herein, the actuator assembly of the hearing prosthesis is configured to electronically communicate with this processor. For example, when this processor is provided with the output of a speaker or the like, the processor processes this output, and converts the output into an electronic signal that is provided to the actuator assembly so as to actuate the actuator assembly and thus evoke a hearing percept based on the captured sound. The actuation of the actuator assembly occurs because of the electrical signal that is provided thereto by the sound processor either directly or indirectly. In this exemplary embodiment, the hearing prosthesis is configured to enable the processor to read either directly or indirectly (e.g., indirectly can correspond to the separate interrogator in the embodiments detailed above, and directly can correspond to an integrated interrogator and to the sound processor) the electronic data retained in the actuator assembly.

Some utilitarian features associated with the ability to read the data stored in the memory will now be described.

Figure 27:
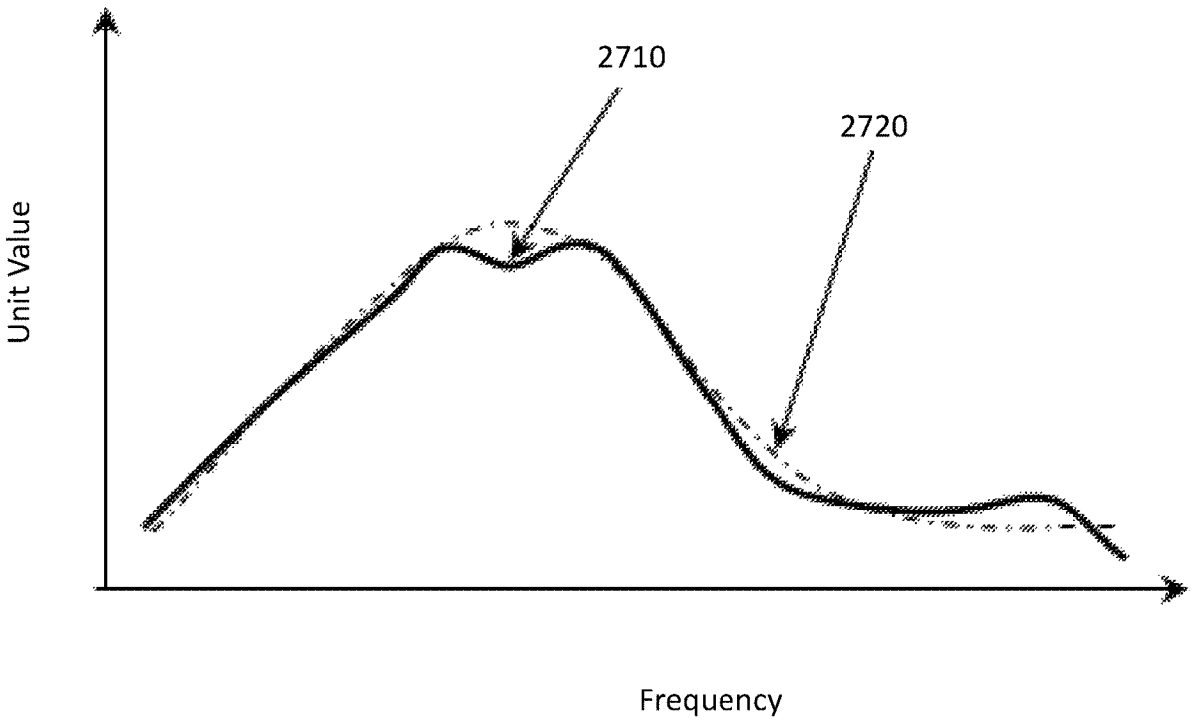
FIG. 27 depicts an exemplary graph depicting ideal versus actual performance of an exemplary actuator unit according to an exemplary embodiment.

A given transducer assembly will have near inherent manufacturing tolerances therein. That is, barring a freak occurrence, even utilizing the most advanced manufacturing capabilities, a given actuator assembly will perform differently in response to a signal indicative of a captured sound relative to another actuator assembly manufactured on the exact same assembly line by the exact same machine by the exact same executer of the manufacturing actions thereof (human or robot). Still further, these performance differences could be exaggerated depending on the economies associated with the manufacturing process. For example, a given actuator assembly must have economic viability for its intended use. Thus, manufacturing processes that are not 100% optimized must be utilized in some instances. In any event, any given actuator will perform differently from any other given actuator all other things being equal. In this regard, FIG. 27 depicts an exemplary graph depicting a unit value of performance relative to a given frequency of a sound input. Curve 2710 corresponds to the actual performance of the actuator assembly and curve 2720 corresponds to the intended performance/goal performance (ideal performance) of the actuator assembly. That is, in some exemplary embodiments, the goal of any manufacturing effort to manufacture the transducer assembly is to achieve an output of the transducer assembly according to the goal performance curve. It is noted that in other exemplary embodiments, the goal performance curve can be different than that depicted in FIG. 27. Indeed, in an exemplary embodiment, the goal performance curve is simply a design goal to "standardize" the performance of a given actuator for a given frequency with respect to a production run, where the processor of a given prosthesis or the like is programmed with that goal in mind (the idea being that the actuators will be manufactured such that that performance goal is at least approximated in a manner having utilitarian value) and the processor is such that the output thereof to the actuator can be adjusted based on the known performance goal to achieve a desired or otherwise utilitarian output of the actuator.

Still, the issue is that the actuator assembly, while likely operating within an acceptable tolerance regime, will be different relative to another actuator assembly due to manufacturing differences. Corollary to this is that the actuator assembly will have a different output for the exact same input relative to that which is the case for another actuator assembly. Because in some instances, the actual operational performance of the actuator is not known, and the output to the actuator from the sound processor will be based on the ideal performance values/the ideal operational performance of a given actuator, the output of the actuator will be different than that which is intended for the given output from the sound processor. This is the case because a given sound processor is married with a given actuator in a blind fashion. That is, the actual operational performance of the given actuator assembly is not known to the sound processor.

Thus, in an exemplary embodiment, the actual operational performance of a specific actuator assembly is identified prior to marrying with the given sound processor. In an exemplary embodiment, each actuator assembly is tested with respect to a given input, and the output is measured or otherwise determined and recorded. FIG. 27 depicts an exemplary performance of an exemplary actuator assembly for a given input (which input can be output from a sound processor). In an exemplary embodiment, the output of the actuator is evaluated and compared to the ideal performance/performance goal and an adjustment regime applicable the output of the sound processor is developed so as to make the actuator perform according to the ideal performance/performance goal for a given input into the sound processor. That is, this adjustment regime corresponds to how the output of the sound processor would be different for a given input to achieve the performance goal. This adjustment regime can be stored in the memory. In an exemplary embodiment, this adjustment regime can correspond to data that can be used by the sound processor to adjust the processing capabilities so as to achieve an output to the actuator assembly for a given input into the sound processor that will result in the goal performance of the actuator assembly. In an exemplary embodiment, this can be frequency based and/or magnitude based. For example, for a given processing regime, the data stored in the memory can be data that, when accessed by the sound processor, will instruct the processor to increase an amplitude of the output signal for a captured sound at 1000 Hz by a certain amount or to decrease in amplitude of the output signal for a captured sound at 1000 Hz by a certain amount, which output signal is ultimately delivered to the actuator assembly so as to actuate the actuator assembly and ultimately evoke a hearing percept due to the actuation thereof. Still further, for a given processing regime, the data stored in the memory can be data that, when accessed by the sound processor, will instruct the processor to shift the output frequency by a certain value for a given input frequency. Any data that can be utilized as instruction to a given sound processor so as to adjust the output of the sound processor so as to achieve an actual performance of a given transducer closer to the goal performance of the given transducer can be stored in the memory of the actuator assembly in at least some exemplary embodiments.

That said, in some alternate embodiments, the data stored in the memory of the actuator assembly corresponds to the actual performance of the actuator. That is, the data does not necessarily correspond to instruction data that is utilized by the sound processor (or other control unit/device of the hearing prosthesis) in a processing regime thereof/instruction data that is utilized by the sound processor to alter an existing sound processing regime of the sound processor. Accordingly, in an exemplary embodiment, the sound processor or other control unit of the hearing prosthesis can read this performance data from the memory, and reconfigure, or otherwise adjust the algorithms utilized by the sound processor so the output of the sound processor that is ultimately provided to the actuator assembly actuate the actuator so that the output of the actuator assembly corresponds to the goal performance for the given input. That is, in an exemplary embodiment, the sound processor or otherwise the control unit that is utilized by the prosthesis includes an algorithm that enables the prosthesis to evaluate the performance data stored in the memory and develop an algorithm or otherwise that is stored in the prosthesis and apply that selected algorithm or apply the developed algorithm to process sound and output a signal that will result in an output of the prosthesis closer to the goal performance thereof.

Thus, as used herein, the phrase "data related to an operational performance of the actuator assembly" includes both instructional data that is utilized by the hearing prosthesis to reconfigure or otherwise change a processing regime of the sound processor and the "raw performance data" that can be utilized by the prosthesis to develop or otherwise select a processing regime.

Accordingly, in an exemplary embodiment, the hearing prosthesis is configured to at least one of adjust, select, or develop an operating regime of the processor based on the data stored in the memory. (Herein, the phrase "modifying an operating regime" entails adjustment to an existing operating regime, selecting an operating regime from a plurality of pre-existing operating regimes, and developing a new operating regime.) Corollary to this is that in an exemplary embodiment, the hearing prosthesis is configured to control an energizement signal provided to the actuator to cause the actuator to vibrate based in part on the data stored in the memory (and, based in part on sound captured by the hearing prosthesis). Thus, in an exemplary embodiment, the hearing prosthesis is configured to control an energizement signal provided to the actuator assembly to account for manufacturing tolerances of the actuator assembly based at least in part on the data stored in the memory.

In view of the above, it is to be understood that at least some of the above exemplary embodiments have utilitarian value with respect to enabling a more accurate output of a given actuator assembly for a given input relative to that which would be the case in the absence of the utilization of the memory detailed herein. Still further, in view of the above, it is to be understood that at least some of the above exemplary embodiments have utilitarian value with respect to providing a manufacturing operation where the specific performance/actual performance capabilities of a given actuator assembly and/or correction data for a given actuator assembly can be stored in a machine readable manner with the actuator assembly such that upon the action of marrying the sound processor with the actuator assembly, that data can be read automatically by the sound processor or other pertinent components of the prosthesis and the system can self-calibrate itself so as to take into account the aforementioned manufacturing tolerances of the actuator assembly. Note also that the teachings detailed herein can have utilitarian value with respect to scenarios where the actuator assembly is replaced, relative to the sound processor, and the actual performance data of the new actuator assembly can be read by the sound processor or other controlling component of the prosthesis so that the utilitarian value associated with creating or otherwise adjusting or otherwise selecting a given actuator regime based on the actual performance of the actuator assembly can be implemented vis-à-vis the replacement actuator assembly. In this regard, it is noted that the teachings detailed herein regarding the manufacturing processes associated with marrying a given actuator assembly with a given sound processor as well as the teachings detailed herein regarding replacing a given actuator assembly with a given sound processor are applicable to any of the embodiments detailed herein and/or variations thereof that have been disclosed as having a sound processor and a actuator apparatus.

With respect to embodiments where the sound processor or other component that utilizes the data stored in the memory is located in a BTE device or an external component of an active transcutaneous bone conduction device, in an exemplary embodiment, the actuator assembly is removably connected to the chassis, the actuator assembly is electrically connected to a component fixed to the chassis, and the hearing prosthesis is configured such that data stored in the memory is accessible from a location remote from the actuator assembly, at least as far as beyond the chassis (e.g., accessible from the BTE device or the external component of the act of transmitting is bone conduction device).

Figure 28:
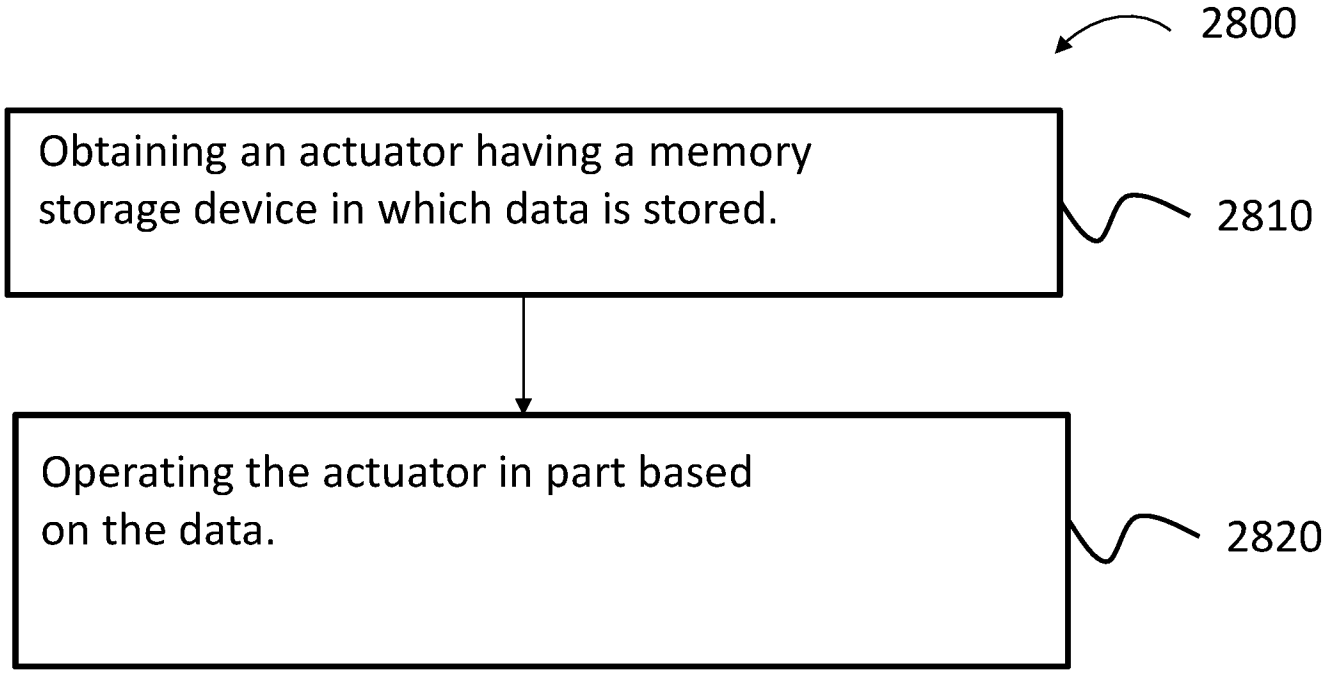
FIG. 28 presents an exemplary flowchart according to an exemplary method according to an exemplary embodiment.

In view of the above, it is to be understood that some exemplary embodiments include methods implementing the teachings detailed herein. In this regard, FIG. 28 depicts an exemplary flowchart for a method 2800, which includes method action 2810, which entails obtaining an actuator having a memory storage device in which data is stored. In an exemplary embodiment, method action 2810 can correspond to obtaining the actuator assembly 1900 detailed above and/or variations thereof. Method 2800 further includes method action 2820, which entails operating the actuator in part based on the data. In an exemplary embodiment, this is done by a adjusting or selecting or developing a control regime of the sound processor based on the data stored in the memory of actuator assembly 1900 in accordance with the teachings detailed herein and/or variations thereof.

In an exemplary embodiment, method 2800 further includes the action of applying a control signal to the actuator to actuate the actuator. In an exemplary embodiment, the control signal is outputted either directly or indirectly by the sound processor based on a captured sound. In this exemplary method action, the control signal is different from that which would be the case in the absence of the data that is stored in the actuator, all other things being equal. In this regard, such a method action reflects the fact that the sound processor or the like utilizes a sound processing algorithm that is different than that which would be the case in the absence of the data. In an exemplary embodiment, the sound processor outputs a signal that is different relative to that which would be the case, all other things being equal, for a given input due to the fact that the sound processor operates differently so as to achieve a goal performance of the actuator for the given input.

In view of the above, it is to be understood that method 2800 can be executed such that the actuator is part of a hearing prosthesis. It is further understood that in some alternate embodiments, method 2800 can be executed such that the actuator is part of a prosthesis that is different from a hearing prosthesis. By way of example only and not by way of limitation, the actuator can be part of a limb prosthesis (e.g., one that moves an artificial finger/artificial thumb). In this regard, in a manner analogous to the differences between the goal performance of the actual performance of a bone conduction actuator or an actuator of a hearing prosthesis, the actuator of this artificial limb prosthesis will also have manufacturing tolerances. In this regard, the processor can be a processor that receives input (e.g., signals from a neural sensor) and analyzes the input to provide an output to the actuator so as to move the actuator in a manner having utilitarian value based on the input. The control regime that is utilized by the processor can be developed and/or modified and/or adjusted and/or selected in a manner concomitant with the teachings detailed herein with respect to the hearing prosthesis.

Still, returning to the embodiment where the actuator is part of the hearing prosthesis, method action 2820 can be executed further in part based on a captured sound, again concomitant with the utilization of actuator that is part of a hearing prostheses. Still further, the action of operating the actuator (method action 2820) in part based on the data accounts for tolerances in the actuator such that for a given captured sound, the output of the actuator is the same as a hypothetical actuator that has tighter tolerances. In an exemplary embodiment, this hypothetical actuator can be an ideal actuator where tolerance error is 0%. In an exemplary embodiment, this hypothetical actuator can be an actuator that always outputs the goal performance for a given input. Thus, utilizing the data stored in the memory or otherwise recorded in the actuator, the performance of the actuator is closer to that of the goal performance than that which would be the case in the absence of the data. Corollary to this, method 2800 is thus a method of remediating tolerance error, where the remediation is based on the data stored in the actuator.

Still further with respect to the method 2800, in an exemplary embodiment, method action 2810 comprises obtaining a hearing prosthesis including a sound processor, the hearing prosthesis having been fitted to a recipient (an exemplary method also includes fitting the hearing prosthesis prior to executing method 2800). In this regard, in an exemplary embodiment, the sound processor is part of a hearing prosthesis that has already been used by the recipient, and the hearing prosthesis has been fitted to the recipient. In an exemplary embodiment, fitting entails making adjustments to the algorithm utilized by the sound processor to accommodate the particular physiological aspects of the recipient. In an exemplary embodiment, the fitting has been executed according to any of the traditional fitting methods and techniques in the art.

Figure 29:
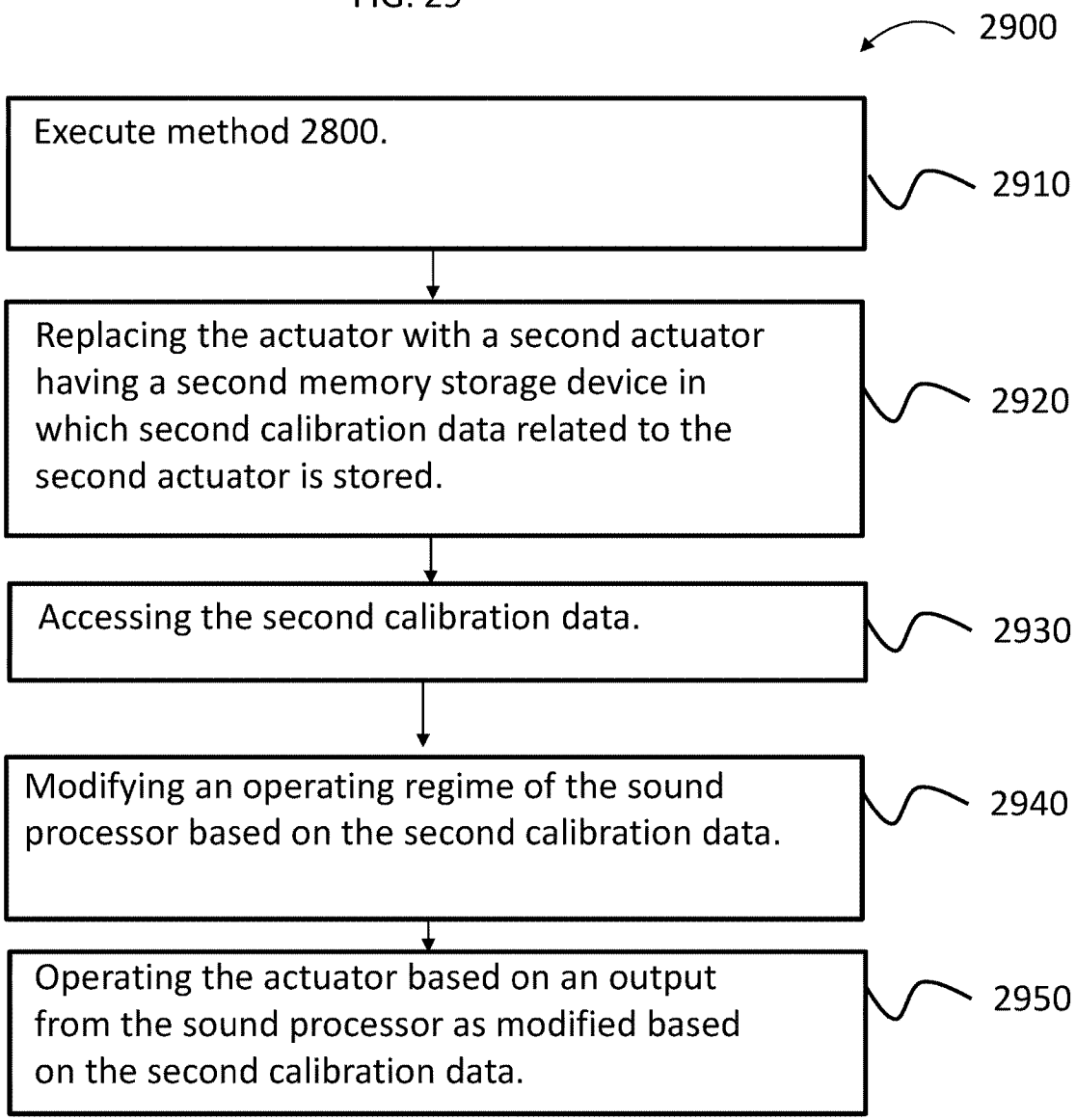
FIG. 29 presents another exemplary flowchart according to an exemplary method according to an exemplary embodiment.

Continuing this exemplary embodiment, and/or with respect to other embodiments, the data that is stored or otherwise retained in a memory can be calibration data relating to the actuator. In this regard, FIG. 29 depicts an exemplary flowchart for an exemplary method 2900. Particularly, method 2900 includes method action 2910, which entails executing method 2800, where the data stored or otherwise retained the memory is calibration data relating to the actuator obtained in method action 2810, and where the actuator obtained in method action 2810 is an actuator that is part of a hearing prosthesis including a sound processor, the hearing prosthesis having been fitted to the recipient. Method 2900 further includes method action 2920, which entails replacing the actuator of the hearing prosthesis with a second actuator. The second actuator has a second memory storage device in which second calibration data related to the second actuator is stored. In an exemplary embodiment, this can correspond to replacing the actuator 900 with the actuator 900A with respect to FIG. 13A, or replacing the remote vibrator actuator unit 349 with the remote vibrator actuator unit 349A with respect to the embodiment of FIGS. 14-16, etc. Continuing with method 2900, method 2900 further includes method action 2930, which entails accessing the second calibration data. In an exemplary embodiment, this can be executed utilizing any of the devices, systems, and/or techniques detailed herein (e.g., reading the memory via a wired connection there with, interrogating the memory via an interrogator utilizing a wireless link, etc.). Any device, system, and/or method that can entail accessing the calibration data or other data stored in the memory can be utilized in at least some exemplary embodiments.

Method 2900 further includes method action 2940, which entails modifying an operating regime of the sound processor based on the second calibration data (selecting an operating regime from a plurality of pre-existing operating regimes, adjusting a current operating regime, developing a new operating regime, etc.). In this regard, the action of modifying an operating regime of the sound processor can entail selecting a new processor regime, modifying an existing processing regime, or developing an entirely new processing regime based on the data.

Method 2900 further includes method action 2950, which entails operating the actuator based on an output from the sound processor (the sound processor that was utilized to execute method action 2810, where with respect to method 2900, the action of obtaining the actuator comprises obtaining a hearing prosthesis including a sound processor fitted to the recipient) as modified based on the second calibration data. In this regard, the modified output of the sound processor corresponds to the output of the sound processor that is different relative to that which would be the case were it not for the data stored in the memory of the second actuator and the modifications to the operating regime, all other things being equal. That is, based on the data that was stored in the memory associated with the new actuator (the second actuator), the operation of the sound processor will be different for the same input so as to control the actuator assembly such that the output thereof will be the same or at least more close to that which would be the case or otherwise would have been the case were the old actuator to have been used for the given input (at least with respect to the usage thereof at fitting/proximate the end of fitting or otherwise prior to any degradation of the actuator that resulted in a determination that the first actuator should be replaced by the second actuator). In an exemplary embodiment, this can have utilitarian value with respect to obtaining the same hearing percept or at least an indistinguishable hearing percept relative to that which would have resulted utilizing the first actuator for the same input even though the second actuator would perform differently for a given input thereto relative to that of the first actuator. In an exemplary embodiment, this can enable such without refitting the hearing prosthesis to the recipient.

Figure 30:
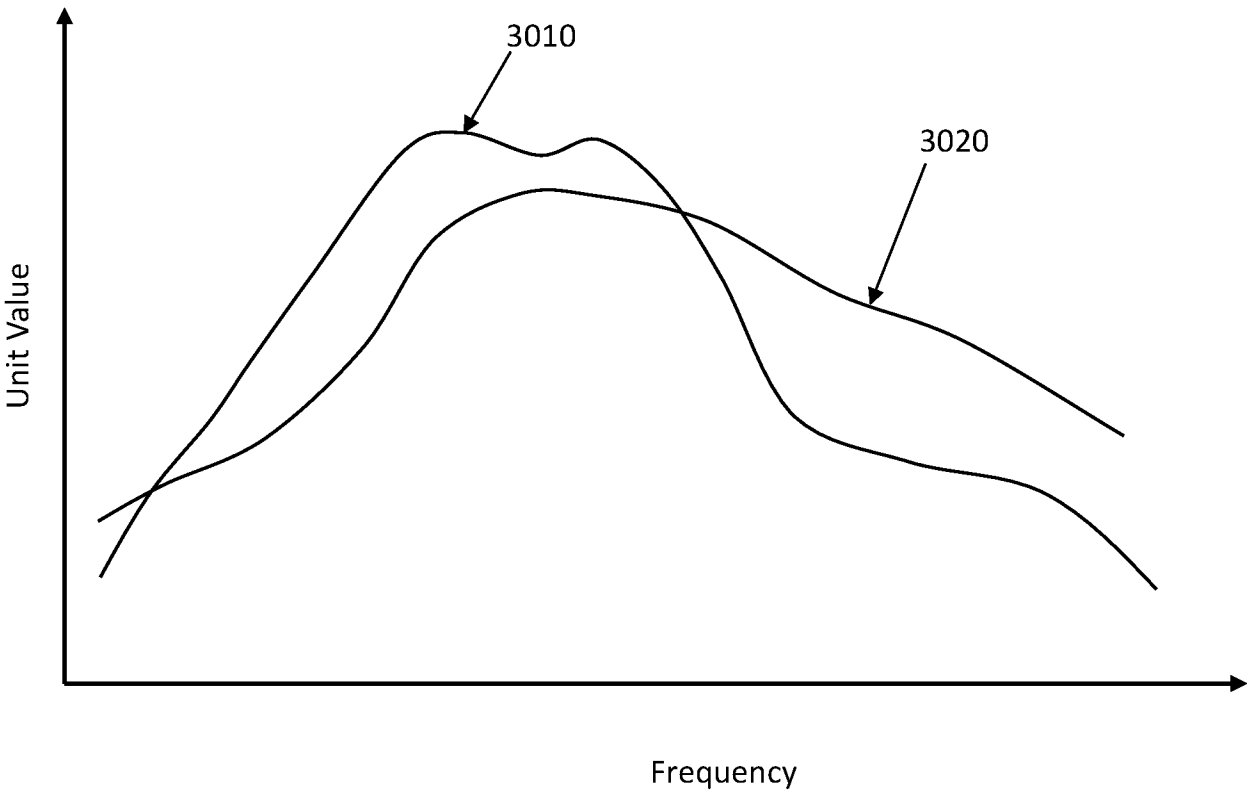
FIG. 30 presents another exemplary graph depicting data having utility with respect to conveying the teachings detailed herein.

Note also that while the teachings detailed herein have been directed towards an actuator that is different from another actuator with respect to degree, and not kind (e.g., model X actuator serial number 00200 vs model X actuator serial number 014025), these teachings can be applicable to an actuator that is different in kind as well (e.g., model Y or model Z vs. model X). Thus, in an exemplary embodiment, method 2900 can be executed as part of an upgrade program, where the second actuator is a new and improved and different and better model than that of the first actuator. By way of example only and not by way of limitation, a new remote vibrator actuator unit can be mailed to the recipient and the recipient can unplug the old remote vibrator actuator unit from the spine of the BTE device and plug-in the new remote vibrator actuator unit, and the BTE device can read the data from the memory and adjust the operation of the sound processor to account for the fact that there is a completely new and different model of an actuator in the new remote vibrator actuator unit. Thus, while the exemplary curves depicted on FIG. 27 have been directed towards addressing tolerancing issues, the teachings detailed herein can be utilized to address the exemplary differences between the different models as depicted by way of example in FIG. 30, where curve 3010 could correspond to the model X actuator originally used by the prosthesis, and curve 3020 can correspond to the model Y actuator that is replacing the model X actuator. The memory could include data that will enable the hearing prosthesis to reconfigure itself to operate with the new model such that for a given input into the sound processor, the hearing percept will be the same (or at least the output of the remote vibrator actuator unit will be the same) as that which would have been the case if the older model was being used (at least that which would have been the case when the older model was originally fitted to the recipient/the older model was in a more pristine condition in the event that some degradation of the actuator has occurred owing to, for example, normal wear and tear). Note further that the teachings detailed herein can be utilized to achieve performance that corresponds to an intermediate fitting event. For example, a given hearing prosthesis can be refitted to the recipient a period of time after original fitting (months and/or years later). Thus, the teachings detailed herein can be applied to achieve a somewhat seamless replacement of an actuator such that the prosthesis will operate in a manner concomitant time with that which was the case at the last fitting (which presumably provided the recipient with desirable hearing percepts relative to that which was the case prior to this refitting).

Figure 31:
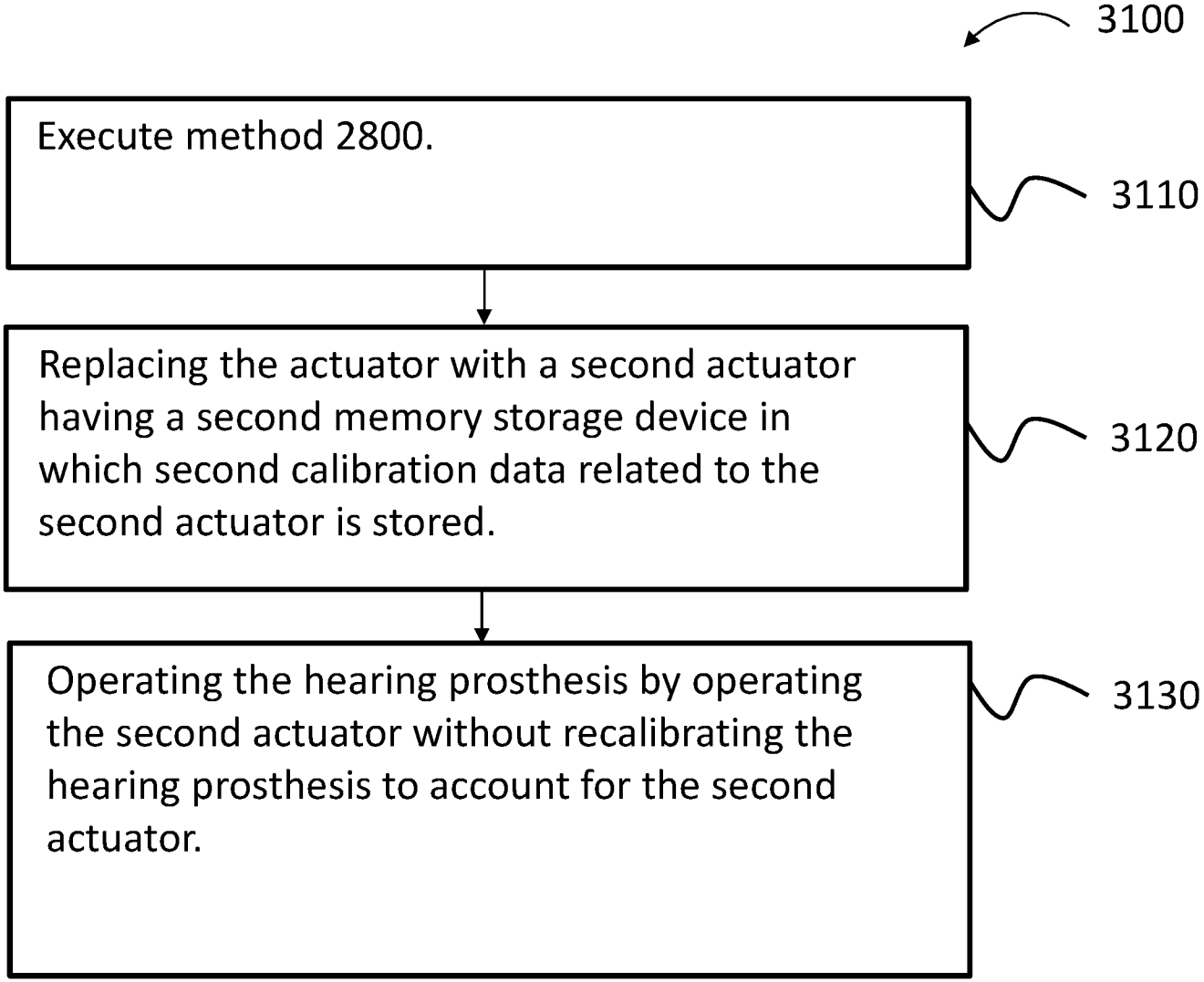
FIG. 31 presents another exemplary flowchart according to an exemplary method according to an exemplary embodiment.

It is noted that in at least some exemplary embodiments, a given hearing prosthesis is calibrated after the actuator is married with the sound processor. In an exemplary embodiment, this is done for each prosthesis. That is, in an exemplary scenario, each manufactured hearing prosthesis is calibrated prior to delivery to a customer. This is done in some embodiments because the specific operational features of a given actuator are not known from one actuator to another, and thus it is only after the actuator has been acquired that these calibrations are executed. By utilizing the teachings detailed herein, the action of calibrating the hearing prosthesis after marrying of the actuator to the sound processor can be skipped. This is because the specific data associated with the given actuator can be utilized to avoid having to calibrate the hearing prosthesis after marrying of the sound processor with the actuator. Corollary to this is that the calibration actions need not be executed in a scenario where the actuator is replaced. To this end, FIG. 31 presents a flowchart for an exemplary method 3100. Method

3100 includes method action 3110, which entails executing method 2800 where the action of obtaining an actuator having a memory storage device in which data is stored comprises obtaining a hearing prosthesis including a sound processor, where the hearing prosthesis has been fitted to a recipient. Method 3100 further includes method 3120, which entails subsequent to method 3110, replacing the actuator with a second actuator having a second memory storage device in which second calibration data related to the second actuator is stored. Method action 3100 further includes method action 3130, which entails operating the hearing prosthesis by operating the second actuator without recalibrating the hearing prosthesis to account for the second actuator. In this exemplary embodiment, the output of the hearing prosthesis is the same when operating the second actuator as that which would have been the case with the original actuator for the given input even though the second actuator responds differently to the given input.

In an exemplary embodiment, for a given input, a parameter of the output of the first actuator that can be measured has a deviation of at least 0.1%, 0.2%, 0.3%, 0.4%, 0.5, 0.6, 0.7, 0.8, 0.9, 1.0, 1.25, 1.5, 1.75, 2, 2.5, 3, 3.5, 4, 4.5, 5, 5.5, 6, 7, 8, 9, 10% or more or any value or range of values therebetween in 0.01% increments (0.24%, 01.33%, 0.55% to 4.78%) from that of the second actuator for that input, all other things being equal. In an exemplary embodiment, the input is input corresponding to a 50 percentile speech sound that would evoke a hearing percept in the recipient. In an exemplary embodiment, the input is a pure sine wave presented at 50 dBs, 55 dBs, 60 dBs, 65 dBs, 70 dBs, 75 dBs, or 80 dBs.

In view of the above, it is to be understood that in an exemplary method, there is a method that entails executing one or more of the actions detailed herein, along with capturing a sound signal. In an exemplary embodiment, this captured sound signal corresponds to the sound captured by the microphone of the hearing prosthesis. In another exemplary embodiment, this captured sound signal corresponds to that which is provided via a wireless and/or a wired system (such as from a MP3 player in the latter case). In these exemplary methods, there is further an action of converting the captured sounds to an electrical signal. In an exemplary embodiment, this is executed via the sound processor. These exemplary methods further include providing the electrical signal to operate the actuator of the hearing prosthesis. In an exemplary embodiment, this electrical signal is provided via cable 14348. Still further, continuing with this exemplary method, the provided signal is based in part on the captured sound, and thus is also based in part on the data stored in the memory storage device.

Referring back to FIG. 27, it can be seen that the data stored in the memory has utilitarian value with respect to adjusting the operation of the actuator in a different manner for different frequencies. In an exemplary embodiment, by way of example, for a frequency of 3000 Hz, if the output of the actuator for a given feature had a 3% deviation from the ideal performance, the control regime would be such that the output of the sound processor would adjust the operation of the actuator so as to increase this feature by 3%, relative to that which would be the case in the absence of the data. Conversely, still by way of example, for a frequency of 1000 Hz, if the output of the actuator for a given feature had a 0% deviation from the ideal performance, the control regime would be such that the output of the sound processor would not adjust the operation of the actuator. Thus, in an exemplary embodiment, there is an exemplary method that entails executing one or more of the actions detailed herein and/or variations thereof, further comprising the action of capturing a sound signal in converting the captured sound signal to an electrical signal. This exemplary method further includes providing the electrical signal to operate the actuator of a hearing prosthesis such that the actuator vibrates to evoke a hearing percept at a plurality of frequencies. In this exemplary method, the provided electrical signal is produced based in part on the data stored in the memory such that the signal is different for different frequencies based on the data stored in the memory beyond that which would be the case without operating the actuator in part based on the data stored in the memory.

To be clear, as noted above, while the teachings detailed herein with respect to the addition of the memory to the actuator assembly have been directed towards an actuator assembly utilized a bone conduction device, such can also be applicable to actuators of a middle ear implant and/or a speaker/receiver of a conventional acoustic hearing aid. Also as noted above, the actuators can be related to a non-sensory prosthesis. Thus, the teachings detailed herein can be applicable to, for example, the actuators of an artificial limb that permits components thereof (e.g., fingers) to move, etc.

Figure 32:
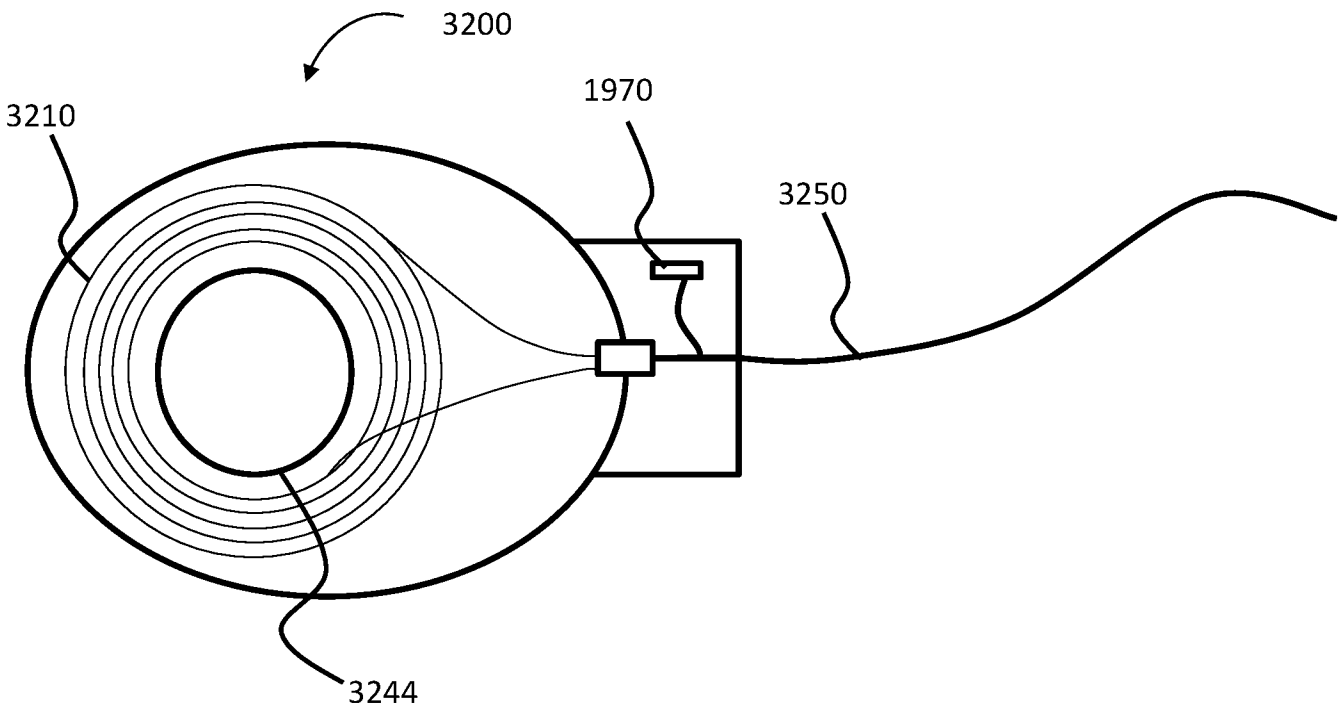
FIG. 32 present an exemplary device application of the teachings detailed herein to an inductance coil.

Note also that the teachings detailed herein are also applicable to other types of transducers and other components of a prosthesis that have manufacturing tolerances of the like that impacted performance thereof. In this regard, FIG. 32 depicts an exemplary inductance coil assembly 3200, which includes an inductance coil 3210 that is in signal communication with a cable 3250. In this exemplary embodiment, the inductance coil assembly can correspond to the component of a cochlear implant that is magnetically attached to the outside of the skin that communicates with an implanted inductance coil. In this regard, as seen in FIG. 32, the inductance coil assembly includes a magnet 3244. It is also noted that in an exemplary embodiment, the inductance coil assembly of FIG. 32 can be utilized in place of the remote actuator unit of FIG. 5A in a scenario where the behind the ear device thereof is utilized in an active transcutaneous bone conduction device. That is, the coil 3210 can correspond to the coil 442/transmitter coil 442 of the embodiment of FIG. 4. Thus, in an exemplary embodiment, cable 3250 is plugged in or otherwise attached to the spine 330B.

As can be seen in FIG. 32, the inductance coil assembly includes a memory 1970 that is in signal communication with the cable 3250. In an exemplary embodiment, the memory includes calibration data or the like relating to the coil. In this regard, for a given input into the coil, there will be an ideal output/goal output and an actual output in a manner analogous to that described above with respect to the actuators. In an exemplary embodiment, the teachings detailed herein can be applied to remedy or otherwise address or otherwise compensate this tolerance error in a manner analogous to those detailed above with respect to the actuator. By way of example only and not by way of limitation, a specific transmitter's coil inductance and/or other features associated there with can be measured during manufacturing and stored in the memory 1970. This information can be accessed by a sound processor or other type of controller and utilized to establish a modified regime to control the coil 3210 so that the output of the coil is the same as or otherwise more closely approaches that of the ideal/goal performance.

It is also noted that the teachings just detailed with respect to the coil 3210 can also be applicable to the implantable coil as well. It is noted that the phrase "inductance coil assembly" corresponds to the component that includes the inductance coil that is readily replaceable with respect to the rest of the prostheses. For example, the inductance coil assembly 3200 of FIG. 32 is readily replaceable with respect to the entirety of the BTE device, whether that be a bone conduction device or a middle ear implant or a cochlear implant. Conversely, the coil of an implantable receiver-stimulator may not necessarily be replaceable, while in some alternate embodiments, the implantable coil could be a separate component somewhat analogous to that depicted in FIG. 32 that is readily connectable to the stimulator unit and readily disconnectable from the stimulator unit.

It is noted that while the teachings detailed above have generally been directed towards a memory device, such as memory 1970, that includes static data/data that is sets at a given point and does not change, or at least data that is provided in the memory at the time that the actuator is initially tested or otherwise fabricated or the like. Alternatively and/or in addition to this, some exemplary embodiments include a memory that includes dynamic data. In an exemplary embodiment, the hearing prostheses detailed herein and/or variations thereof are configured so as to enable dynamic data to be recorded on/in the memory (e.g., memory 1970). That is, in an exemplary embodiment, the hearing prosthesis can be configured so as to enable data to be stored in the memory at temporal location after the actuator is needed or otherwise connected to the rest of the hearing prostheses. In this regard, in an exemplary embodiment, the memory is utilized in at least some exemplary embodiments in analogous to a miniature flight recorder. That said, in at least some exemplary embodiments, the analogy is more closely directed to a car computer that has the ability to record fault codes or the like, or otherwise record abnormal or rare occurrences, and not record normal or frequent events. By way of example only and not by way of imitation, the dynamic data can correspond to, in at least some exemplary embodiments, the temporal period of use of the device (e.g., the number of hours that the actuator has been actually used to evoke a hearing percept or the number of hours that the hearing prosthesis was operational such that upon the capture of sound, the actuator would have been energized to evoke a hearing percept (which is more than the time that the actuator was utilized to evoke a hearing percept, because there would be periods of time of silence where the actuator), etc.

The dynamic data stored in the memory device can also correspond to such temporal data as the time elapsed since cleaning of one or more components, oiling or otherwise servicing one or more components known to require such service or otherwise components were it is known that such service can have utilitarian value, time that the hearing prostheses was attached to a recipient, etc. In at least some exemplary embodiments, the dynamic data can be such that the data is recorded over upon the occurrence of an event. For example, the device can be configured such that upon the opening of the housing or the like, under a given set of circumstances indicative of the actuator being cleaned, the data relating to the time since last cleaning is reset.

Still further by way of example only and not by way of limitation, the dynamic data can correspond to histograms associated with a given sound environment and/or sound environments encountered by the prostheses. Corollary to the concept of the mini flight recorder, in an exemplary embodiment, error codes of interest could be stored in the memory.

Note also that performance data can be stored in the memory. By way of example only and not by way of limitation, the prosthesis can be configured so as to store event data rising to a significant occurrence. By way of example only and not by way limitation, the prosthesis can store in the memory the number of occurrences that the vibrator was utilized at a given frequency and a given amplitude, which given frequencies and amplitudes are known to overstress the actuator is such occurs on a statistically frequent basis. The dynamic data can correspond to quantitative occurrence data (e.g., event X occurred 7 times), or can correspond to qualitative occurrence data (actuator produced frequency Y at amplitude Z). The hearing prosthesis can be configured to combine the qualitative data and the quantitative data.

Note also that the memory can include dynamic data relating to upgrades or changes or modifications to the hearing prostheses. By way of example only and not by way limitation, in a scenario where the signal processor is updated, the memory can store information relating to the update (e.g. date of update, model of the sound processor that was replaced, model of the new sound processor etc.).

Figure 33:
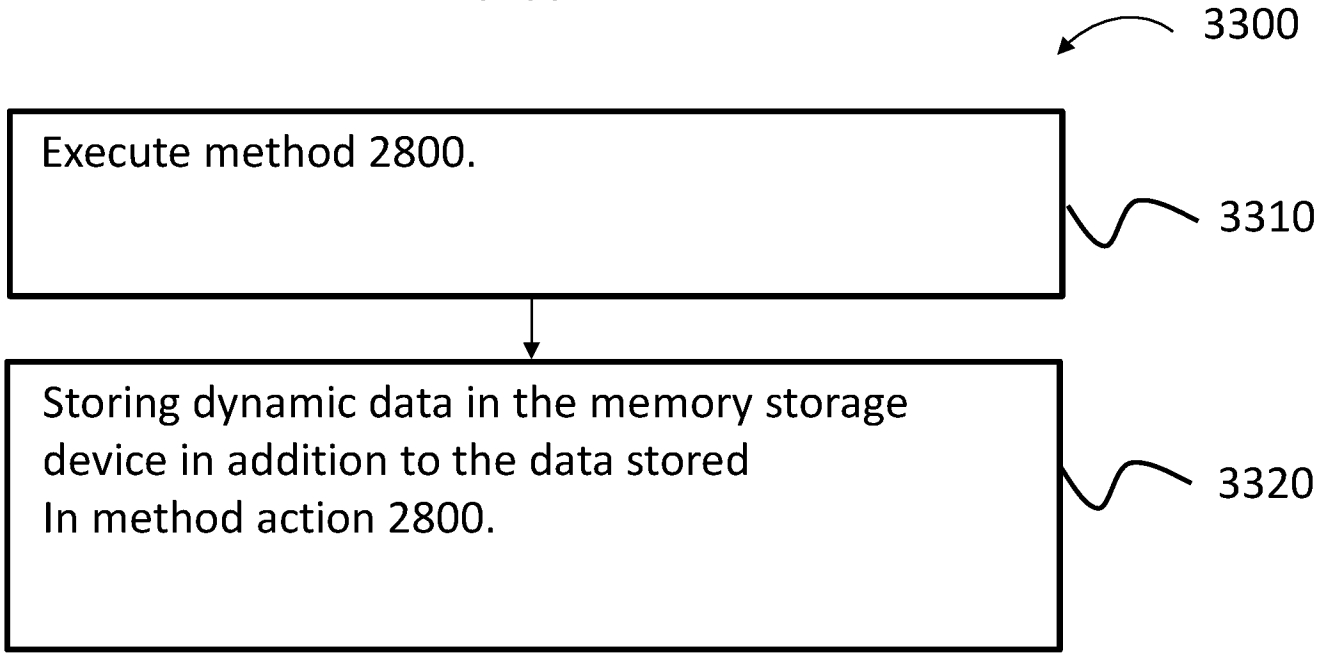
FIG. 33 present an exemplary flowchart for an exemplary embodiment.

In view the above, an exemplary embodiment includes a method represented by the flowchart of FIG. 33, method 3300. Method 3300 includes method action 3310, which entails executing method 2800. Method 3300 further includes method action 3320, which entails storing dynamic data in the memory storage device in addition to the data stored in method action 2800. In an exemplary embodiment, method action 3320 occurs after the execution of method action 3310. By way of example only and not by way limitation, the dynamic data of method action 3320 can correspond to an error code or the like, or one of the temporal data points detailed above or variations thereof.

In an exemplary embodiment, there is a method as detailed above and/or below, wherein the actuator is part of a hearing prosthesis, the action of operating the actuator is further at least in part based on a captured sound, and the action of operating the actuator at least in part based on the data accounts for tolerances in the actuator such that for a given captured sound, the output of the actuator is the same as a hypothetical actuator that has tighter tolerances.

In an exemplary embodiment, there is a method as detailed above and/or below, further comprising the action of storing dynamic data in the memory storage device in addition to the data, wherein the action of storing the dynamic data is executed automatically as a result of an event occurring after the data is stored in the memory storage device.

In an exemplary embodiment there is a hearing prosthesis as detailed above and/or below, wherein the hearing prosthesis is configured to control an energizement signal provided to the actuator assembly to account for manufacturing tolerances of the actuator assembly based at least in part on the data. In an exemplary embodiment there is a hearing prosthesis as detailed above and/or below, wherein the actuator includes a memory that retains the data, wherein the memory is located on the first apparatus.

In an exemplary embodiment, there is a device as detailed above and/or below, wherein the transducer is an actuator that is devoid of any other electronic components except for electronic components making up the memory device, electronic components that induce actuation forces in the transducer and input-output apparatuses thereof if present in the device. In an exemplary embodiment, the device is a bone conduction device.

It is noted that any disclosure herein of a method action singularly or in combination with other method actions corresponds to a disclosure of a device and/or system for implementing those method action(s). It is also noted that any disclosure herein of a method of manufacturing a given device corresponds to a disclosure of the resulting device. It is also noted that any disclosure herein of a device and/or system corresponds to a disclosure of a method of utilizing that device and/or system. The disclosure of any component herein having a functionality corresponds to a method of implementing that device to have that functionality, as well as a method in general where the results of that functionality are achieved.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A hearing device, comprising:

a transducer including a machine readable memory device directly attached to the transducer, wherein the transducer includes a seismic mass and a stationary structure to which the seismic mass is movably attached, wherein the memory device is directly attached to the stationary structure.

2. The device of claim 1, wherein:

the transducer is an actuator.

3. The device of claim 1, wherein:

the transducer is an actuator of a hearing prosthesis.

4. The device of claim 1, wherein:

the device is a hearing prosthesis;

the memory device includes static data; and the memory device includes dynamic data stored therein by the hearing prosthesis.

5. The device of claim 1, wherein:

the transducer includes a seismic mass and a stationary structure to which the seismic mass is movably attached, wherein the memory device is directly attached to the stationary structure.

6. The device of claim 1, wherein:

the transducer is configured to be removably mounted to a body interface component.

7. A mechanical output hearing prosthesis, comprising:

an actuator assembly; and a chassis supporting the actuator assembly, wherein the actuator assembly is configured to vibrate when an electrical current is applied to the actuator assembly such that a first apparatus of the actuator assembly vibrates relative to a second apparatus of the actuator assembly, the vibration evoking a hearing percept in a recipient when the hearing prosthesis is attached to the recipient, the chassis is connected to the second apparatus, and the actuator assembly retains data related to an operational performance of the actuator assembly.

8. The hearing prosthesis of claim 7, wherein:

the hearing prosthesis further includes a processor that is remote from the actuator assembly;

the actuator assembly is configured to electronically communicate with the processor; and the hearing prosthesis is configured to enable the processor to read the data retained in the actuator assembly.

9. The hearing prosthesis of claim 8, wherein:

the hearing prosthesis is configured to at least one of adjust, select, or develop an operating regime of the processor based on the data.

10. The hearing prosthesis device of claim 7, wherein:

the hearing prosthesis is configured to control an energizement signal provided to the actuator assembly to cause the actuator assembly to vibrate based in part on the data.

11. The hearing prosthesis of claim 7, wherein:

the actuator assembly is removably connected to the chassis;

the actuator assembly is electrically connected to a component fixed to the chassis; and the hearing prosthesis is configured such that the data is accessible from a location remote from the actuator assembly at least as far as beyond the chassis.

12. The hearing prosthesis of claim 7, wherein:

the hearing prosthesis is a bone conduction device.

13. A method for implementation in a medical device, comprising:

obtaining an assembly including a housing and a transducer having a memory storage device in which data is stored, wherein the transducer is located in the housing: and operating the transducer in part based on the data.

14. The method of claim 13, further comprising:

applying a control signal to the transducer to actuate the transducer, wherein the control signal is different from that which would be the case in the absence of the data, all other things being equal, wherein the transducer is an actuator.

15. The method of claim 13, further comprising:

capturing a sound signal;

converting the captured sound to an electrical signal;

providing the electrical signal to operate the transducer, wherein the provided electric signal is based in part on the captured sound, wherein the transducer is an actuator.

16. The method of claim 13, further comprising:

capturing a sound signal;

converting the captured sound to an electrical signal;

providing the electrical signal to operate the the transducer such that the transducer vibrates to evoke a hearing percept at a plurality of frequencies, wherein the provided electrical signal is produced based in part on the data such that the signal is different for different frequencies beyond that which would be the case without the data, and wherein the transducer is an actuator.

17. The method of claim 13, wherein:

the method is a method of remediating tolerance error in the transducer based on the data.

18. The method of claim 13, wherein:

the transducer is a first transducer;

the action of obtaining the first transducer having a memory storage device in which data is stored comprises obtaining a hearing prosthesis including a sound processor, the hearing prosthesis having been fitted to a recipient;

the data is calibration data related to the transducer;

the method further comprises, subsequent to the action of operating the first transducer at least in part based on the data:

replacing the first transducer with a second transducer having a second memory storage device in which second calibration data related to the second transducer is stored;

accessing the second calibration data;

modifying an operating regime of the sound processor based on the second calibration data; and operating the second transducer based on an output from the sound processor as modified based on the second calibration data.

19. The method of claim 13, wherein:

the transducer is a first transducer;

the action of obtaining the first transducer having a memory storage device in which data is stored comprises obtaining a hearing prosthesis including a sound processor, the hearing prosthesis having been fitted to a recipient;

the method further comprises, subsequent to the action of operating the first transducer at least in part based on the data:

replacing the first transducer with a second transducer having a second memory storage device in which second calibration data related to the second transducer is stored; and operating the hearing prosthesis by operating the second transducer without recalibrating the hearing prosthesis to account for the second transducer, wherein the second transducer responds differently to a given input than the first transducer, and wherein for a given sound captured by the hearing prosthesis, the output of the hearing prosthesis is the same when operating the second transducer as that which would have been the case with the first transducer for the given input even though the second transducer responds differently to the given input.

20. The method of claim 13, wherein:

the transducer is an actuator.

21. The method of claim 17, wherein:

the transducer is an actuator.

* * * * *